US008849155B2

(12) United States Patent
Kamimura

(10) Patent No.: US 8,849,155 B2
(45) Date of Patent: Sep. 30, 2014

(54) IMAGE FORMING DEVICE

(75) Inventor: Naoya Kamimura, Ichinomiya (JP)
(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 798 days.

(21) Appl. No.: 13/073,239

(22) Filed: Mar. 28, 2011

(65) Prior Publication Data

US 2012/0020699 A1 Jan. 26, 2012

(30) Foreign Application Priority Data

Jul. 23, 2010 (JP) ..... 2010-165769
Jul. 23, 2010 (JP) ..... 2010-165770

(51) Int. Cl.
*G03G 21/16* (2006.01)
*G03G 15/08* (2006.01)

(52) U.S. Cl.
CPC .... *G03G 15/0896* (2013.01); *G03G 2221/1684* (2013.01); *G03G 21/1642* (2013.01); *G03G 15/0813* (2013.01); *G03G 2215/0692* (2013.01)
USPC ..... 399/111

(58) Field of Classification Search
USPC ..... 399/111
See application file for complete search history.

(56) References Cited

U.S. PATENT DOCUMENTS

| | | | | |
|---|---|---|---|---|
| 7,561,817 | B2 | 7/2009 | Sato | |
| 8,086,116 | B2 | 12/2011 | Hamaya | |
| 8,203,586 | B2 * | 6/2012 | Kaneko et al. | 347/241 |
| 2002/0172533 | A1 | 11/2002 | Ishiguro et al. | |
| 2003/0219284 | A1 | 11/2003 | Ishiguro et al. | |
| 2006/0193652 | A1 | 8/2006 | Sato | |
| 2007/0160388 | A1 | 7/2007 | Yoshimura et al. | |
| 2009/0245817 | A1 | 10/2009 | Hamaya | |
| 2010/0135694 | A1 | 6/2010 | Hashimoto et al. | |

FOREIGN PATENT DOCUMENTS

| | | | |
|---|---|---|---|
| JP | 62-193241 | A | 8/1987 |
| JP | 06-019238 | A | 1/1994 |
| JP | 08-240977 | | 9/1996 |
| JP | 2002-341652 | | 11/2002 |
| JP | 2003-345130 | | 12/2003 |
| JP | 2006-154519 | A | 6/2006 |
| JP | 2006-235472 | A | 9/2006 |
| JP | 2007-213025 | | 8/2007 |
| JP | 2008-299139 | A | 12/2008 |
| JP | 2009-244568 | A | 10/2009 |
| JP | 2010-128184 | A | 6/2010 |
| JP | 2010-128342 | | 6/2010 |

OTHER PUBLICATIONS

Machine translation of JP 2010-128184 A, publication date: Jun. 10, 2010.*
Machine translation of JP 2006-235472 A, publication dated: Sep. 7, 2006.*
JP Office Action mailed May 22, 2012, JP Appln. 2010-165770, English translation.
JP Office Action received in corresponding JP Application No. 2010-165769, mailed Jun. 5, 2012; English Translation.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming device includes a photosensitive unit, a developer cartridge, and a developing device. The photosensitive unit includes a photosensitive body. The developer cartridge accommodates developer therein and has a supported portion supported by the photosensitive unit. The developing device is disposed between the photosensitive unit and the developer cartridge and is supported by the photosensitive unit and is pivotally movable about the supported portion. The developing device includes a developer carrying member carrying the developer thereon. The developer carrying member is movable, in accordance with the pivotal movement of the developing device, between a contact position at which the developer carrying member is in contact with the photosensitive body and a separate position at which the developer carrying member is separated from the photosensitive body.

29 Claims, 15 Drawing Sheets

TOP
BOTTOM
FRONT
REAR
14K(14)
14Y(14)
14M(14)
14C(14)
15K(15)
15Y(15)
15M(15)
15C(15)
18K(18)
18Y(18)
18M(18)
18C(18)
10

IMAGE FORMING DEVICE

CROSS REFERENCE TO RELATED APPLICATION

This application claims priority from Japanese Patent Application No. 2010-165769 filed Jul. 23, 2010 and Japanese Patent Application No. 2010-165770 filed Jul. 23, 2010. The entire content of each of these priority applications is incorporated herein by reference.

TECHNICAL FIELD

The present invention relates to an image forming device.

BACKGROUND

One type of electrophotographic color printer known in the art is a tandem-type color laser printer provided with a process cartridge for each of the toner colors yellow, magenta, cyan, and black. Each process cartridge includes a photosensitive member, and a developing roller for supplying toner to the photosensitive member.

A process cartridge detachably mountable in the body of such a tandem-type color laser printer is proposed. The process cartridge includes a drum unit provided with a photosensitive drum, and a developing unit provided with a developing roller and serving to accommodate toner.

The developing unit in this process cartridge is integrally provided with a developing device frame and a covering member. The developing unit is rotatably supported relative to the drum unit by a projected portion projecting from the developing device frame, and a cylindrical portion projecting from the covering member. The developing unit rotates relative to the drum unit about the projected portion and the cylindrical portion serving as the center of rotation. By rotating the developing unit relative to the drum unit, the developing roller separates from the photosensitive drum.

SUMMARY

The conventional process cartridge described above is integrally provided with the developing unit and the drum unit and is detachably mounted in the body of the printer. Further, the developing unit can rotate about the projected portion and cylindrical portion for separating the developing roller from the photosensitive drum.

However, there has been demand for a developing unit having a developer cartridge accommodating toner (developer) that is separable from a developing device provided with a developing roller so that only the developer cartridge need be replaced for each drum unit (photosensitive member unit).

To achieve this, consideration has been given for a structure that rotates the developing device about a rotational center passing through the developing device in order to separate the developing roller from the photosensitive drum.

However, when the center of rotation is established within the developing device, the developing device rotates when the developer cartridge is mounted on or removed from the photosensitive member unit, making it difficult to fix the position of the developer cartridge relative to the developing device. Consequently, the operation for mounting and removing the developer cartridge relative to the photosensitive member unit is complex.

Further, another conventional color printer has a drawer unit for integrally retaining a plurality of photosensitive drums, and developer cartridges that are detachably mounted in the drawer unit. The developer cartridges are provided so as to be movable between a contact position in which developing rollers contact the respective photosensitive drums and are capable of forming images on the same, and a separated position in which the developing rollers are separated from the photosensitive drums.

However, in the above conventional color laser printer, the drawer unit can be inserted into the main casing of the printer while the developing rollers remain in the separated position. If an image-forming operation is executed while the printer is in this state, the printer cannot form images normally.

It is an object of the present invention to provide an image-forming device capable of facilitating operations to mount a developer cartridge on a photosensitive member unit and to remove the developer cartridge from the same.

Further, it is another object of the present invention to provide an image-forming device capable of preventing such malfunctions.

In order to attain the above and other objects, the invention provides an image forming device including a photosensitive unit, a developer cartridge, and a developing device. The photosensitive unit includes a photosensitive body. The developer cartridge accommodates developer therein and has a supported portion supported by the photosensitive unit. The developing device is disposed between the photosensitive unit and the developer cartridge and is supported by the photosensitive unit and is pivotally movable about the supported portion. The developing device includes a developer carrying member carrying the developer thereon. The developer carrying member is movable, in accordance with the pivotal movement of the developing device, between a contact position at which the developer carrying member is in contact with the photosensitive body and a separate position at which the developer carrying member is separated from the photosensitive body.

According to another aspect, the present invention provides an image forming device including a main frame, an image forming unit, a plurality of developer cartridges, an emitting unit, and a plurality of blocking members. The main frame provides therein an accommodation space. The image forming unit is movable between an accommodated position in which the image forming unit is positioned in the accommodation space and a pulled out position in which the image forming unit is displaced from the accommodated space. The image forming device includes a plurality of photosensitive members juxtaposedly arrayed. The plurality of developer cartridges each accommodates therein developer, and each is detachably mounted on the image forming unit in one to one correspondence with each photosensitive member. The emitting unit is provided in the main frame and is configured to emit a laser beam toward each photosensitive member. Each of the plurality of blocking members is provided at each developer cartridge and is movable between a blocking position at which the laser beam directing toward each photosensitive member is shut-off and a transmitting position allowing the laser beam to reach each photosensitive member.

BRIEF DESCRIPTION OF THE DRAWINGS

The particular features and advantages of the invention as well as other objects will become apparent from the following description taken in connection with the accompanying drawings, in which:

FIG. 5(*b*) is a left side of the developer cartridge shown in FIG. 5(*a*);

FIG. 7(*b*) is a left side of the developer cartridge shown in FIG. 5(*a*) when the handle part of the developer cartridge is in a collapsed state;

FIG. 9(*b*) is a front view of the process unit when the process unit is mounted in the main body;

FIG. 10(*b*) is a cross-section side view of the process unit when each developing device is pressed by the corresponding separating cam;

FIG. 13(*b*) is a cross-section side view of the process unit when each developing device is not pressed by the corresponding separating cam in the color mode;

FIG. 15(*b*) is a cross-section side view of the process unit when each developing device is not pressed by the corresponding separating cam in the monochrome mode.

DETAILED DESCRIPTION

Figure 1:
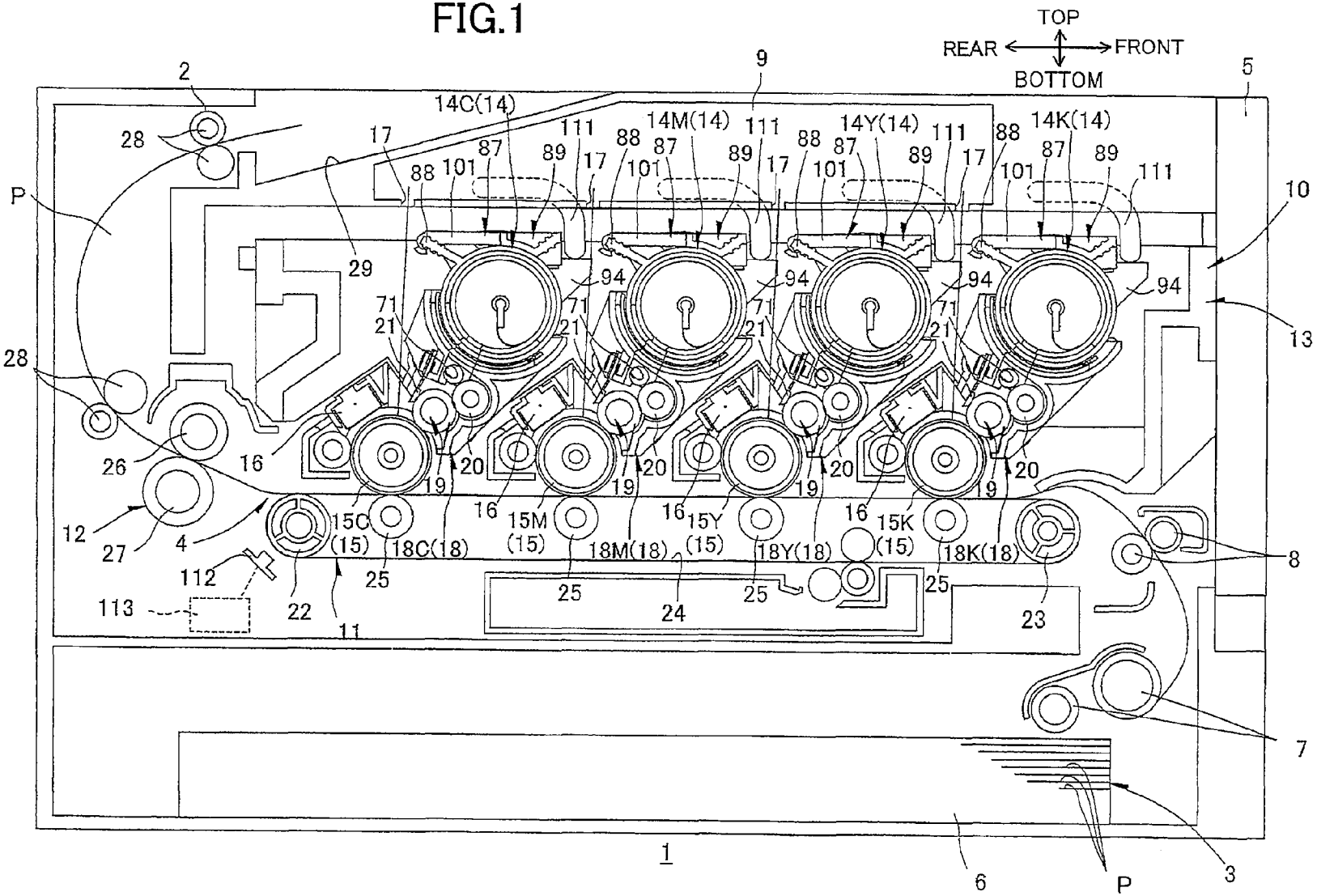
FIG. 1 is a cross-section side view of an image-forming device according to an embodiment of the invention.

An image forming device according to embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming device is disposed in an orientation in which it is intended to be used. In use, the image forming device is disposed as shown in FIG. 1.

1. Overall Structure of a Color Laser Printer

A printer 1 is a direct tandem color laser printer of a horizontal type, whereby photosensitive drums for forming individual colors are juxtaposed horizontally in a tandem arrangement. The printer 1 includes a main casing 2 and, provided in the main casing 2, a sheet-feeding unit 3 for feeding sheets of a paper P to be printed, and an image-forming unit 4 for forming images on the paper P supplied by the sheet-feeding unit 3.

(1) Main Casing

The main casing 2 has a substantially rectangular box shape in a side view for accommodating the sheet-feeding unit 3 and sheet-feeding unit 3. A front cover 5 is provided on one side wall of the main casing 2. The front cover 5 is capable of pivoting relative to the main casing 2 about its lower end and, thus, can be opened to allow mounting and removal of a process unit 10 described later.

In the following description, the side of main casing 2 on which the front cover 5 is provided (the right side in FIG. 1) will be called the "front side," and the opposite side (the left side in FIG. 1) will be called the "rear side." Further, the left and right sides of the main casing 2 will be based on the perspective of a user looking at the printer 1 from the front side. In other words, the near side in FIG. 1 will be the "left side," while the far side will be the "right side."

(2) Sheet-Feeding Unit

The sheet-feeding unit 3 includes a paper tray 6 for accommodating sheets of paper P. The paper tray 6 is removably mounted in the bottom section of the main casing 2. A pair of feeding rollers 7 is disposed above the front end of the paper tray 6, and a pair of registration rollers 8 is disposed above the feeding rollers 7.

The feeding rollers 7 rotate to supply sheets of paper P accommodated in the paper tray 6 to the registration rollers 8 one sheet at a time, and the registration rollers 8 convey the sheets toward the image-forming unit 4 (between photosensitive drums 15 (described later) and a conveying belt 24 (described later)) at a prescribed timing.

(3) Image-Forming Unit

The image-forming unit 4 includes a scanning unit 9, a process unit 10, a transfer unit 11, and a fixing unit 12.

(3-1) Scanning Unit

The scanning unit 9 is disposed in the top section of the main casing 2. Four exit holes 17 are formed in the bottom portion of the scanning unit 9 at positions spaced at intervals in the front-to-rear direction and corresponding to positions of four photosensitive drums 15 (described later). As indicated by solid lines in FIG. 1, the scanning unit 9 irradiates laser beams toward the corresponding photosensitive drums 15 (described later) based on image data. The laser beams exit from the corresponding exit holes 17, pass the rear sides of corresponding toner cartridges 14 (described later), and selectively expose the photosensitive drums 15 (described later).

(3-2) Process Unit (3-2-1) Structure of the Process Unit

The process unit 10 is disposed in the main casing 2 below the scanning unit 9 and above the transfer unit 11. The process unit 10 includes a single drawer unit 13, and four toner cartridges 14 provided for each of the four printing colors. The process unit 10 can be slidably moved between an accommodated position inside the main casing 2, and a withdrawn position outside the main casing 2.

The drawer unit 13 is mounted in the main casing 2 and can slide relative to the main casing 2 in the front-to-rear direction. The drawer unit 13 includes four photosensitive drums 15, four Scorotron chargers 16, and four developing devices 18.

The photosensitive drums 15 are cylindrical in shape and oriented with their axes extending in the left-to-right direction (longitudinal direction). The four photosensitive drums 15 are arranged parallel to each other and spaced at intervals in the front-to-rear direction. The photosensitive drums 15 specifically include, in order from front to rear, a black photosensitive drum 15K, a yellow photosensitive drum 15Y, a magenta photosensitive drum 15M, and a cyan photosensitive drum 15C.

Each of the Scorotron chargers 16 is positioned diagonally above and rearward of the respective photosensitive drum 15. The Scorotron chargers 16 face the respective photosensitive drums 15 but are separated therefrom.

The developing devices 18 are supported in the drawer unit 13 at positions above the corresponding photosensitive drums 15 so as to confront the photosensitive drums 15. The developing devices 18 specifically include, in order from front to rear, a black developing device 18K, a yellow developing device 18Y, a magenta developing device 18M, and a cyan developing device 18C. Each of the developing devices 18 is also provided with a developing roller 19.

As will be described later, the developing roller 19 is rotatably supported in the lower end of the developing device 18 so that the peripheral surface of the developing roller 19 is exposed on the rear side. The developing roller 19 opposes and contacts the upper front edge of the respective photosensitive drum 15.

Each developing device 18 includes a supply roller 20 for supplying toner to the developing roller 19, and a thickness-regulating blade 21 for regulating the layer thickness of toner supplied to the developing roller 19.

The toner cartridges 14 are supported in the drawer unit 13 at positions above corresponding developing devices 18 so as to confront the same. The toner cartridges 14 specifically include, in order from front to rear, a black toner cartridge 14K, a yellow toner cartridge 14Y, a magenta toner cartridge 14M, and a cyan toner cartridge 14C. The toner cartridges 14 are detachably supported in the drawer unit 13 and function to accommodate toner of the corresponding color.

(3-2-2) Developing Operations of the Process Unit

Toner accommodated in the toner cartridge 14 is supplied onto the supply roller 20 in the developing device 18, and the supply roller 20 in turn supplies the toner to the developing roller 19.

As the developing roller 19 rotates, the thickness-regulating blade 21 regulates the thickness of the layer of toner supplied to the developing roller 19 so that the developing roller 19 carries a uniform thin layer of toner on the surface thereof. Further, the toner supplied to the developing roller 19 is positively tribocharged between the developing roller 19 and thickness-regulating blade 21.

In the meantime, the Scorotron charger 16 applies a uniform positive charge to the surface of the photosensitive drum 15 as the photosensitive drum 15 rotates. Subsequently, the scanning unit 9 irradiates laser beams (indicated by solid lines in FIG. 1), exposing the surfaces of the photosensitive drums 15 in a high-speed scan to form electrostatic latent images on the surfaces of the photosensitive drums 15 corresponding to an image to be formed on the paper P.

As the photosensitive drum 15 continues to rotate, the positively charged toner carried on the surface of the developing roller 19 is supplied to the electrostatic latent image formed on the surface of the photosensitive drum 15. The toner develops the latent image into a visible toner image by reversal.

(3-3) Transfer Unit

The transfer unit 11 is disposed inside the main casing 2 above the sheet-feeding unit 3 and below the process unit 10. The transfer unit 11 is elongated in the front-to-rear direction and includes a drive roller 22, a follow roller 23, a conveying belt 24, and four transfer rollers 25.

The drive roller 22 and follow roller 23 are disposed in parallel to each other and are separated in the front-to-rear direction.

The conveying belt 24 is looped around the drive roller 22 and follow roller 23 and is positioned so that its upper portion confronts and contacts each of the photosensitive drums 15 from below. When the drive roller 22 is driven to rotate, the conveying belt 24 circulates so that its upper portion in contact with the photosensitive drums 15 moves rearward.

Each of the transfer rollers 25 is disposed within the inner space defined by the conveying belt 24 at positions opposing respective photosensitive drums 15 through the upper portion of the conveying belt 24.

When a sheet of paper P is supplied from the sheet-feeding unit 3 onto the conveying belt 24, the conveying belt 24 conveys the sheet rearward so that the sheet passes sequentially through transfer positions at which the transfer rollers 25 confront the photosensitive drums 15. As the conveying belt 24 conveys the sheet of paper P, each photosensitive drum 15 sequentially transfers a toner image of the corresponding color onto the paper P to form a color image thereon.

(3-4) Fixing Unit

The fixing unit 12 is positioned on the rear side of the transfer unit 11. The fixing unit 12 includes a heating roller 26, and a pressure roller 27 disposed in confrontation with the heating roller 26. After a color image is transferred onto the paper P, the image is fixed to the paper P by heat and pressure as the paper P passes between the heating roller 26 and pressure roller 27 in the transfer unit 11.

(4) Sheet Discharge

A U-shaped path is formed in the main casing 2 on the downstream side of the transfer unit 11 and leads from the transfer unit 11 to the top of the main casing 2. A sheet-discharge tray 29 is formed on the top of the main casing 2 above the scanning unit 9. Pairs of discharge rollers 28 are provided along the U-shaped path.

After the toner image has been fixed to the sheet of paper P in the transfer unit 11, the discharge rollers 28 convey the sheet along the U-shaped path and discharge the sheet onto the sheet-discharge tray 29.

2. Detailed Description of the Process Unit (1) Drawer Unit

Figure 2:
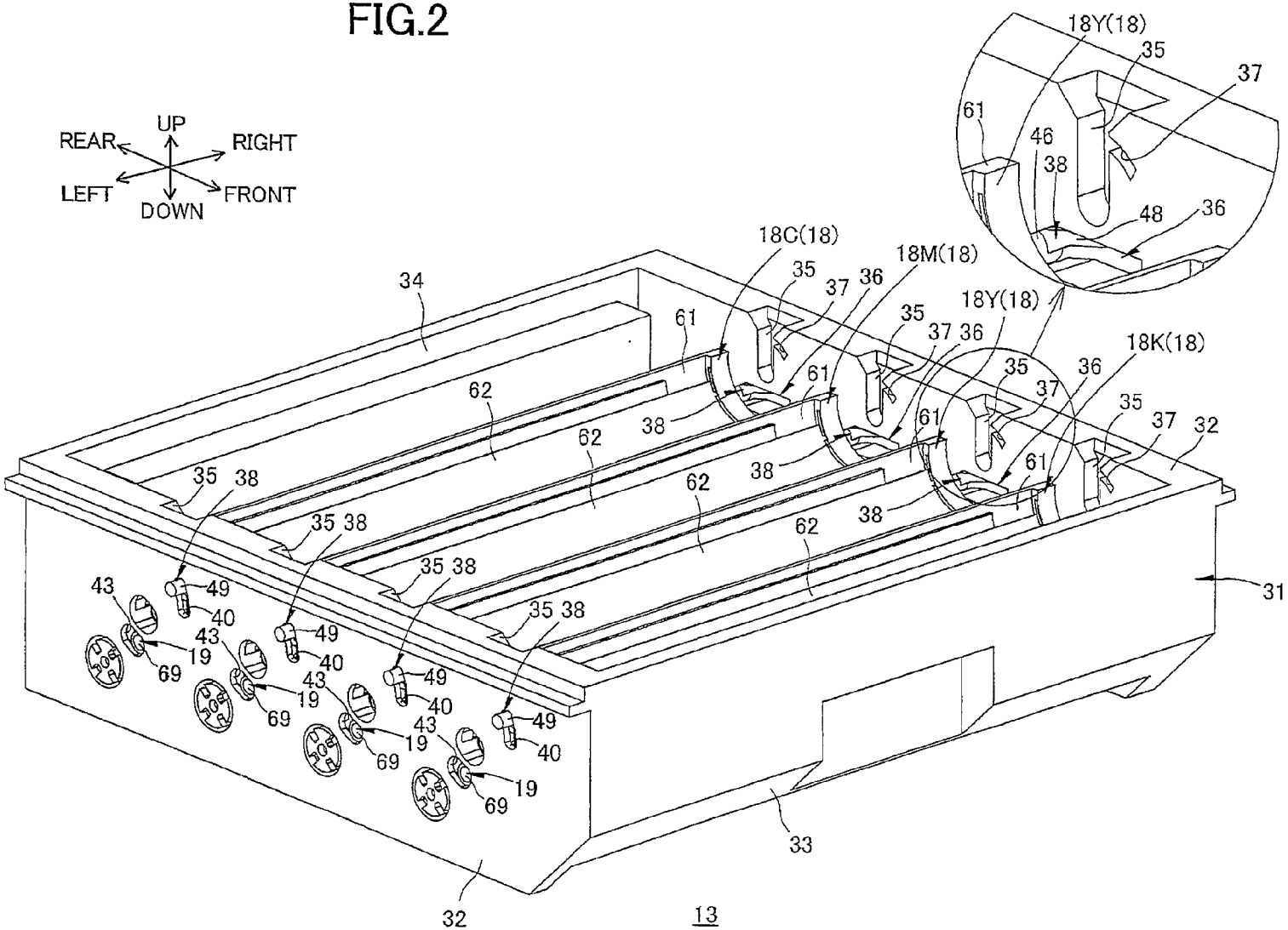
FIG. 2 is a perspective view of a drawer unit provided in the image-forming device shown in FIG. 1.

As shown in FIG. 2, the drawer unit 13 includes a drawer frame 31 having a substantially rectangular frame-like shape in a plan view, and the developing devices 18 supported in the drawer frame 31.

(1-1) Drawer Frame

The drawer frame 31 includes a pair of left and right side plates 32, a front beam 33 bridging the front ends of the side plates 32, and a rear beam 34 bridging the rear ends of the side plates 32.

The side plates 32 are substantially rectangular in shape in a side view and elongated in the front-to-rear direction. The side plates 32 are arranged parallel to each other and spaced away from each other in the left-to-right direction (the longitudinal direction of the photosensitive drums 15). Each of the photosensitive drums 15, Scorotron chargers 16, and developing devices 18 is held between the left and right side plates 32 on the left and right sides thereof.

Figure 3:
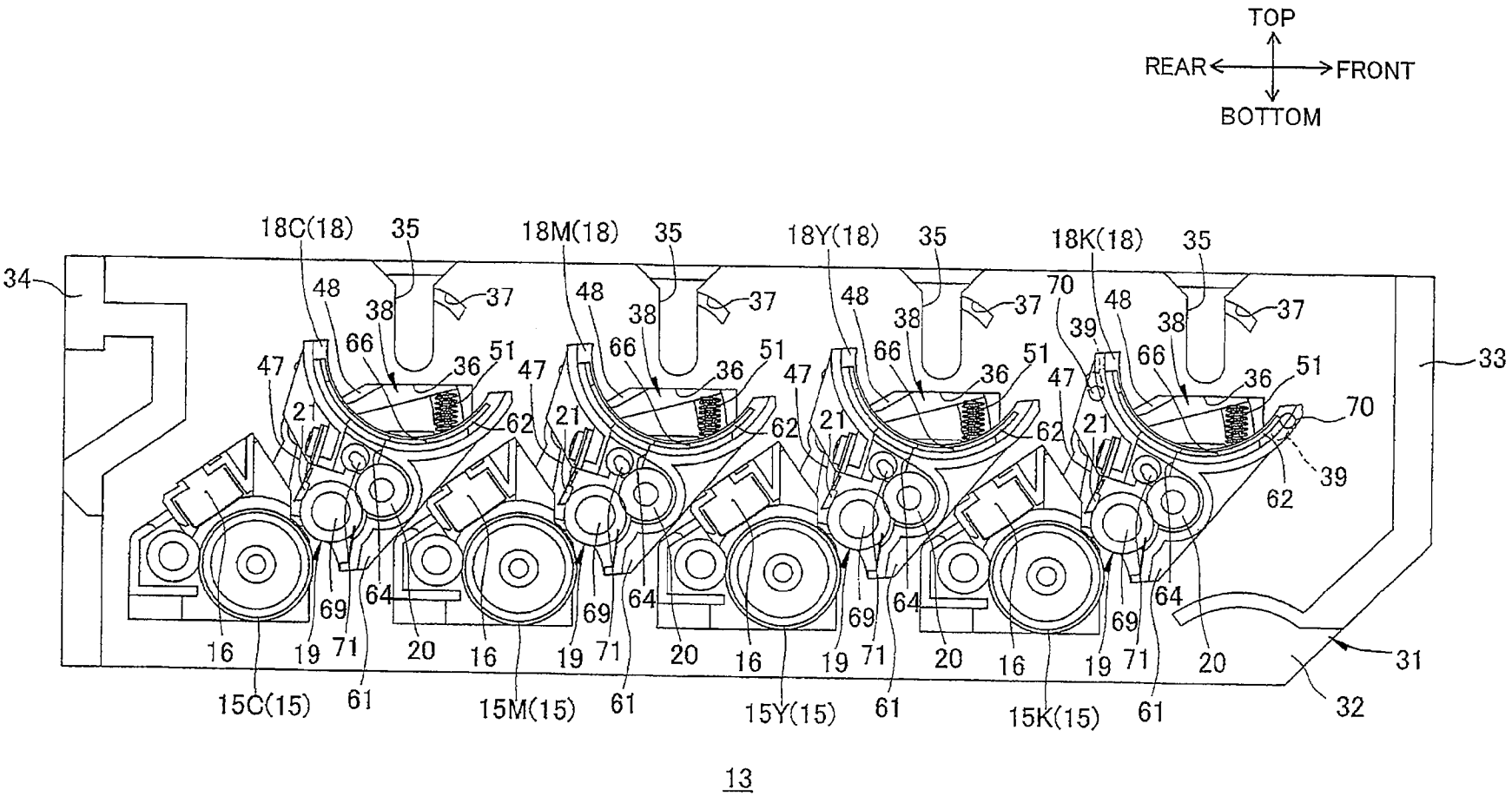
FIG. 3 is a cross-section side view of the drawer unit shown in FIG. 2.

Formed in each of the side plates 32 are cartridge guide grooves 35, separating cam receiving units 36, and pairs of developing device support grooves 39 (see FIG. 3).

The cartridge guide grooves 35 are cut out in the inside surfaces of the side plates 32, extending downward from the top edges of the side plates 32 to a position just above the respective developing devices 18. The upper ends of the cartridge guide grooves 35 widen toward the top, giving the cartridge guide grooves 35 a general Y-shape in a side view. The cartridge guide grooves 35 have a width capable of receiving cartridge support parts 95 (described later) on the toner cartridges 14.

Outer case fitting grooves 37 are formed in the inside surfaces of the side plates 32, one on the front side of each cartridge guide groove 35. The outer case fitting grooves 37 are in communication with the corresponding cartridge guide grooves 35. Specifically, each outer case fitting groove 37 is cut out substantially in an arc shape when viewed from the side, continuing from the front edge of the corresponding cartridge guide groove 35 and curving downward toward the front. The outer case fitting grooves 37 are formed with a width capable of receiving engaging pieces 98 (described later) of outer cases 82 (described later) with some play.

The separating cam receiving units 36 are formed in the inner surfaces of the left and right side plates 32 below each of the cartridge guide grooves 35 and on the outside of both left and right sides of the developing devices 18. The separating cam receiving units 36 are substantially rectangular in a side view and form recesses in the inside surfaces of the left and right side plates 32 that recede partway into the side plates 32.

Figure 9A:
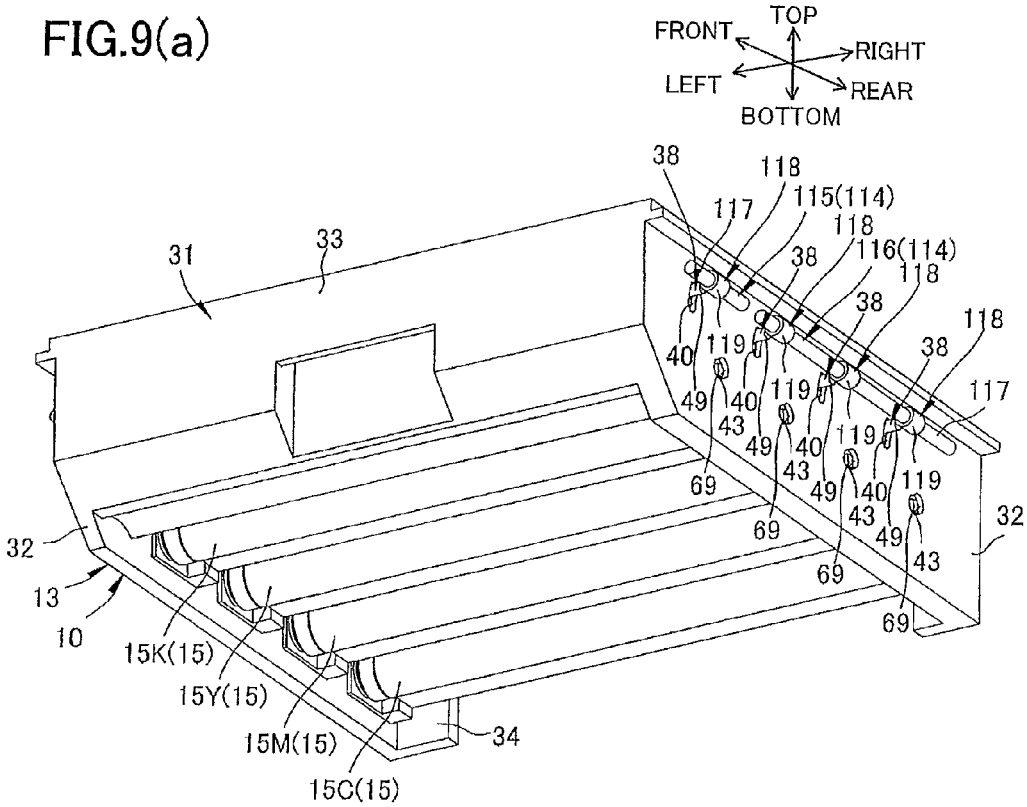
FIG. 9 (*a*) is a perspective view of a process unit provided in the image forming device when the process unit is mounted in a main body of the image forming device.
Figure 9B:
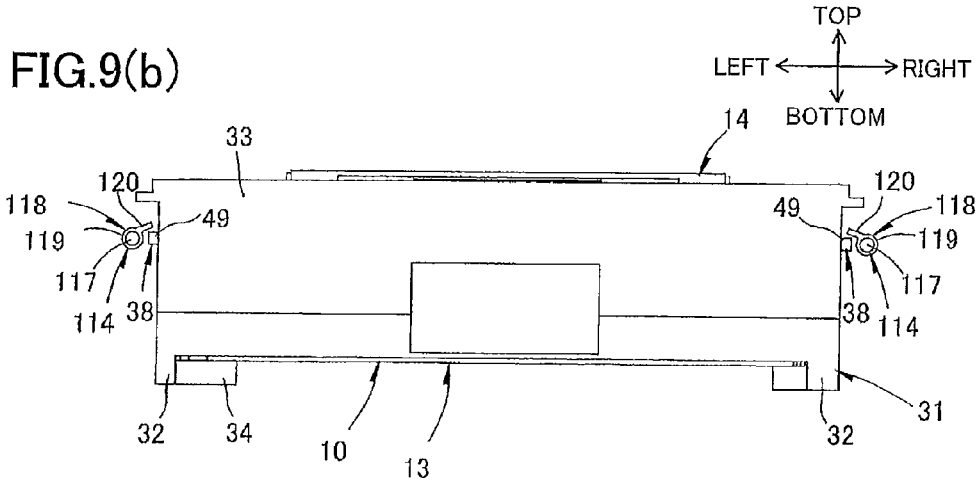

A separating cam exposure hole 40 and a developing roller shaft insertion hole 43 are formed in each of the separating cam receiving units 36 (see FIGS. 2 and 9). A separating cam 38 is accommodated in each separating cam receiving unit 36.

The separating cam exposure holes 40 are vertically elongated holes formed in the upper portions of the side plates 32, penetrating the side plates 32 in the left-to-right direction. The inner end of each separating cam exposure hole 40 is in communication with the upper end of a separating cam receiving unit 36.

The developing roller shaft insertion holes 43 are elongated holes extending in the front-to-rear direction and are formed in the side plates 32 at positions diagonally below and rearward of corresponding separating cam exposure holes 40. The developing roller shaft insertion holes 43 are in substantially the vertical center of the side plates 32 and penetrate the side plates 32 in the left-to-right direction. The inner ends of the developing roller shaft insertion holes 43 are in communication with the lower ends of corresponding separating cam receiving units 36.

Figures 10A, 10B:
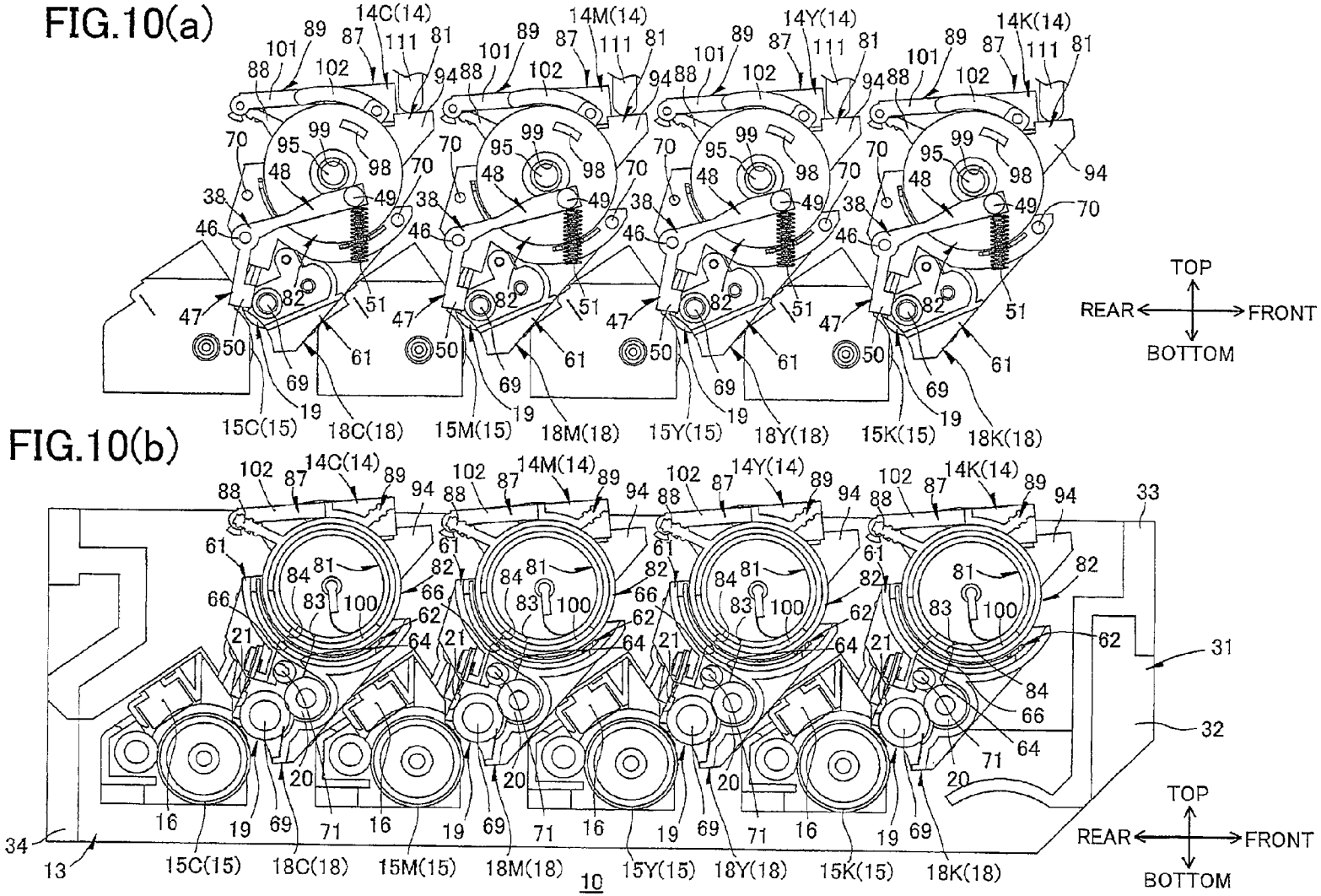
FIG. 10(*a*) is a side view of the process unit when each developing device is pressed by a corresponding separating cam.

As shown in FIG. 10(*a*), the separating cam 38 is integrally provided with a supporting part 46 that is substantially cylindrical in shape, a pressing lever part 47 extending continuously downward from the supporting part 46, and an operating lever part 48 extending continuously forward from the supporting part 46. In a side view, the separating cam 38 has a general L-shape.

The supporting part 46 is rotatably supported inside the separating cam receiving unit 36 at a position above the developing roller 19, when projected in a left-to-right direction.

The pressing lever part 47 extends downward from the supporting part 46 to a position on the rear side of a corresponding developing roller shaft 69 (described later). The lower end of the pressing lever part 47 confronts the developing roller shaft 69 from the rear side. A contact part 50 that is substantially rectangular in a side view is formed on the lower end of the pressing lever part 47. The contact part 50 protrudes forward from the pressing lever part 47 and contacts the developing roller shaft 69.

The operating lever part 48 extends forward from the supporting part 46. A substantially cylindrical operating part 49 is provided on the front end of the operating lever part 48 and extends outward therefrom in both left and right directions. The left and right outer ends of each operating part 49 are inserted into respective separating cam exposure holes 40 formed in the separating cam receiving units 36 from the inner sides thereof and are exposed on the left and right outer sides of the side plates 32. A compressed spring 51 disposed at the front end of each operating lever part 48 constantly urges the front end upward.

As shown in FIG. 3, the developing device support grooves 39 are formed in the inner side surfaces of the left and right side plates 32 at intervals in the front-to-rear direction. The upper ends of the separating cam receiving units 36 are respectively interposed between ends of the developing device support grooves 39 in the front-to-rear direction. In a side view, both developing device support grooves 39 in each pair are formed as elongated holes following the circumference of a circle centered on the bottom end of the corresponding cartridge guide groove 35. The width of the developing device support grooves 39 is sufficient for receiving developing device support bosses 70 (described later) of the developing devices 18.

(1-2) Developing Devices

Figure 4:
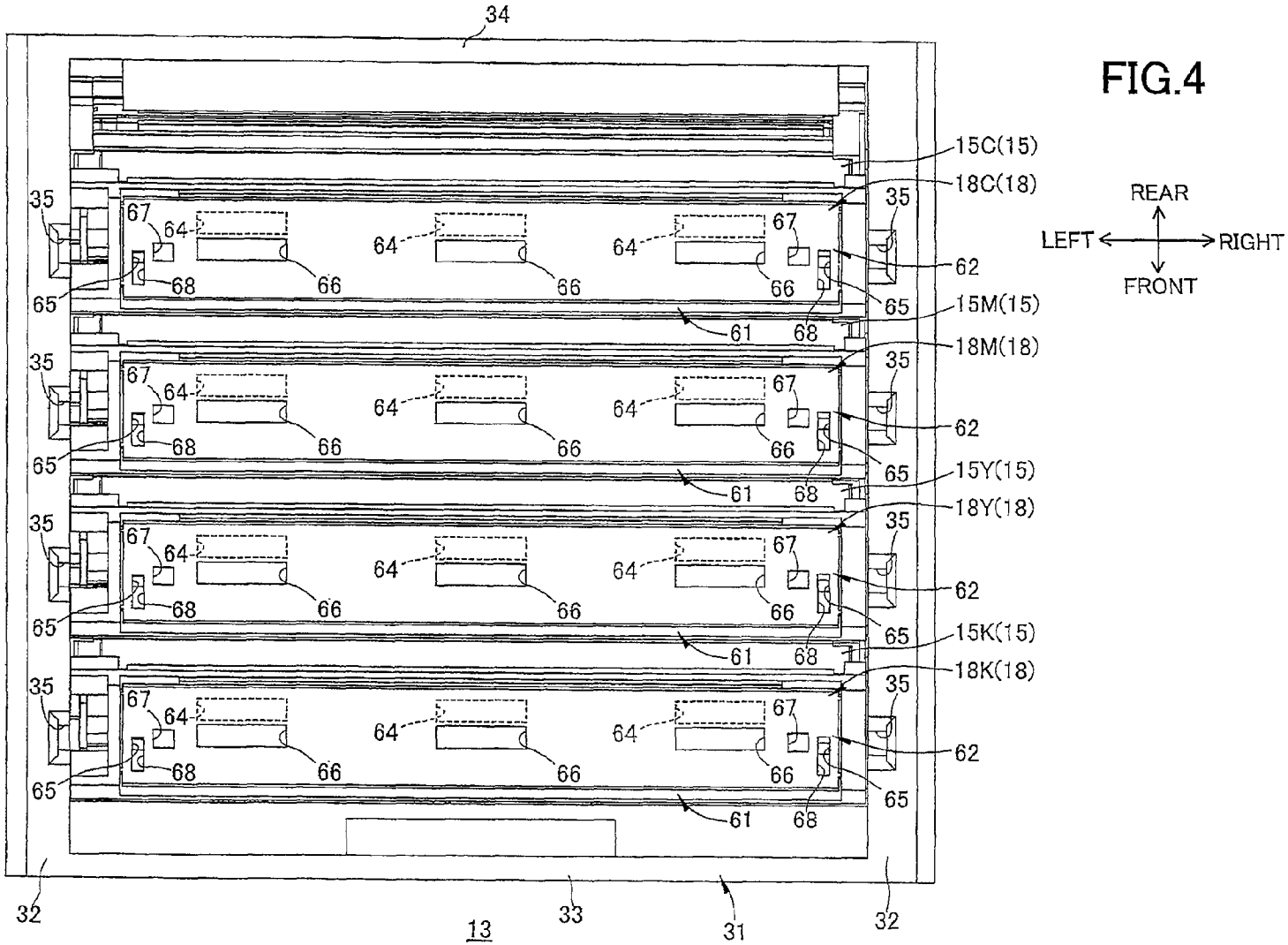
FIG. 4 is a top view of the drawer unit shown in FIG. 2.

As shown in FIGS. 3 and 4, each developing device 18 includes a developing device frame 61, and a developing device shutter 62.

Each developing device frame 61 is formed in a triangular box shape that is elongated in the left-to-right direction. In a side view, the developing device frame 61 is shaped substantially like an isosceles triangle with its vertex angle pointing downward to the rear. The lower portion of the developing device frame 61 is open on the rear side. The developing roller 19 is rotatably supported in the lower portion of the developing device frame 61.

The top wall constituting the developing device frame 61 is substantially arc-shaped in a side view, opening upward, so as to follow the outer peripheral surface of the corresponding toner cartridge 14. Formed in the top wall of each developing device frame 61 are three developer openings 64, and a pair of left and right cartridge fixing holes 65.

The developer openings 64 are arranged in a series at intervals in the left-to-right direction. Each developer opening 64 is substantially rectangular in a plan view and is elongated in the left-to-right direction. The developer openings 64 penetrate the upper wall of the developing device frame 61 vertically to allow passage of toner.

The cartridge fixing holes 65 (FIG. 4) are formed in the top wall of the developing device frame 61, one near each of the left and right ends thereof. The cartridge fixing holes 65 are substantially rectangular in a plan view and are shaped to fit cartridge fixing protrusions 91 (described later) on the toner cartridge 14.

The developing device shutter 62 is supported on the top wall of the corresponding developing device frame 61 so as to be capable of sliding in front and rear directions. Each of the developing device shutters 62 has a plate shape. In a side view, the developing device shutters 62 are substantially arc-shaped, opening upward, so as to conform to the outer peripheral surface of the corresponding toner cartridges 14.

Formed in each developing device shutter 62 are three developing device shutter openings 66, a pair of left and right cartridge fixing protrusion insertion holes 68, and a pair of left and right shutter fixing holes 67.

The developing device shutter openings 66 are arranged in a series at intervals in the left-to-right direction at positions corresponding to the developer openings 64. The developing device shutter openings 66 are substantially rectangular in a plan view.

The cartridge fixing protrusion insertion holes 68 are disposed one on each left and right end of the developing device shutter 62 at positions corresponding to the cartridge fixing holes 65 of the developing device 18. Each cartridge fixing protrusion insertion hole 68 is substantially rectangular in a plan view and elongated in the front-to-rear direction at a length substantially equivalent to the sliding range of the developing device shutter 62. Thus, the cartridge fixing holes 65 are constantly exposed in the cartridge fixing protrusion insertion holes 68 when the developing device shutter 62 slides.

The shutter fixing holes 67 are formed in the developing device shutter 62 at positions inside the rear ends of the cartridge fixing protrusion insertion holes 68 with respect to the left-to-right direction. Each shutter fixing hole 67 is substantially rectangular in a plan view and penetrates the developing device shutter 62. The shutter fixing hole 67 is shaped to receive shutter fixing protrusions 85 (described later) on an outer case 82 (described later).

The developing device shutter 62 is moved between a closed position for covering the developer openings 64 (see FIG. 3) and an open position for revealing the developer openings 64 (see FIG. 10(*b*)). The developing device shutter 62 moves in a rearward direction from the closed position to the open position.

When the developing device shutter 62 is in the closed position, the developing device shutter openings 66 are positioned forward of the developer openings 64. Hence, the developing device shutters 62 cover the developer openings 64 to restrict the passage of toner.

When the developing device shutter 62 is in the open position, the developing device shutter openings 66 are positioned in opposition to the developer openings 64, thereby exposing the developer openings 64 to allow the passage of toner.

An auger 71 is provided inside each developing device frame 61. The auger 71 extends in the left-to-right direction and is rotatably disposed below the corresponding developer opening 64. By rotating, the auger 71 conveys toner supplied into the developing device frame 61 from the toner cartridge 14 in left and right directions.

As described above, each of the developing device frames 61 accommodates the supply roller 20, developing roller 19, and thickness-regulating blade 21. The supply roller 20 confronts the corresponding auger 71 vertically, but is separated a slight distance therefrom. The developing roller 19 contacts the supply roller 20 from a direction diagonally below and rearward thereof. The thickness-regulating blade 21 contacts the top of the developing roller 19.

The developing roller 19 also includes a developing roller shaft 69 as a rotational shaft. The left and right ends of the developing roller shaft 69 are rotatably supported in the developing device 18. More specifically, the left and right ends of the developing roller shaft 69 penetrate the left and right side walls of the developing device 18, protruding toward the left and right side plates 32 of the drawer frame 31, and are positioned in the bottom ends of the corresponding separating cam receiving units 36.

Each developing device frame 61 also includes a pair of front and rear developing device support bosses 70 formed on both left and right side walls near the upper edge of the developing device frame 61.

The developing device support bosses 70 are substantially cylindrical in shape and protrude outward in left and right directions from the left and right edges, respectively.

By slidably fitting the developing device support bosses 70 into the corresponding developing device support grooves 39, the developing device 18 is retained while being capable of pivoting in front and rear directions relative to the drawer frame 31 about the lower ends of the cartridge guide grooves 35. The developing device 18 contacts the photosensitive drum 15 when pivoting forward and separates from the photosensitive drum 15 when pivoting rearward.

(2) Toner Cartridges

Figure 5A:
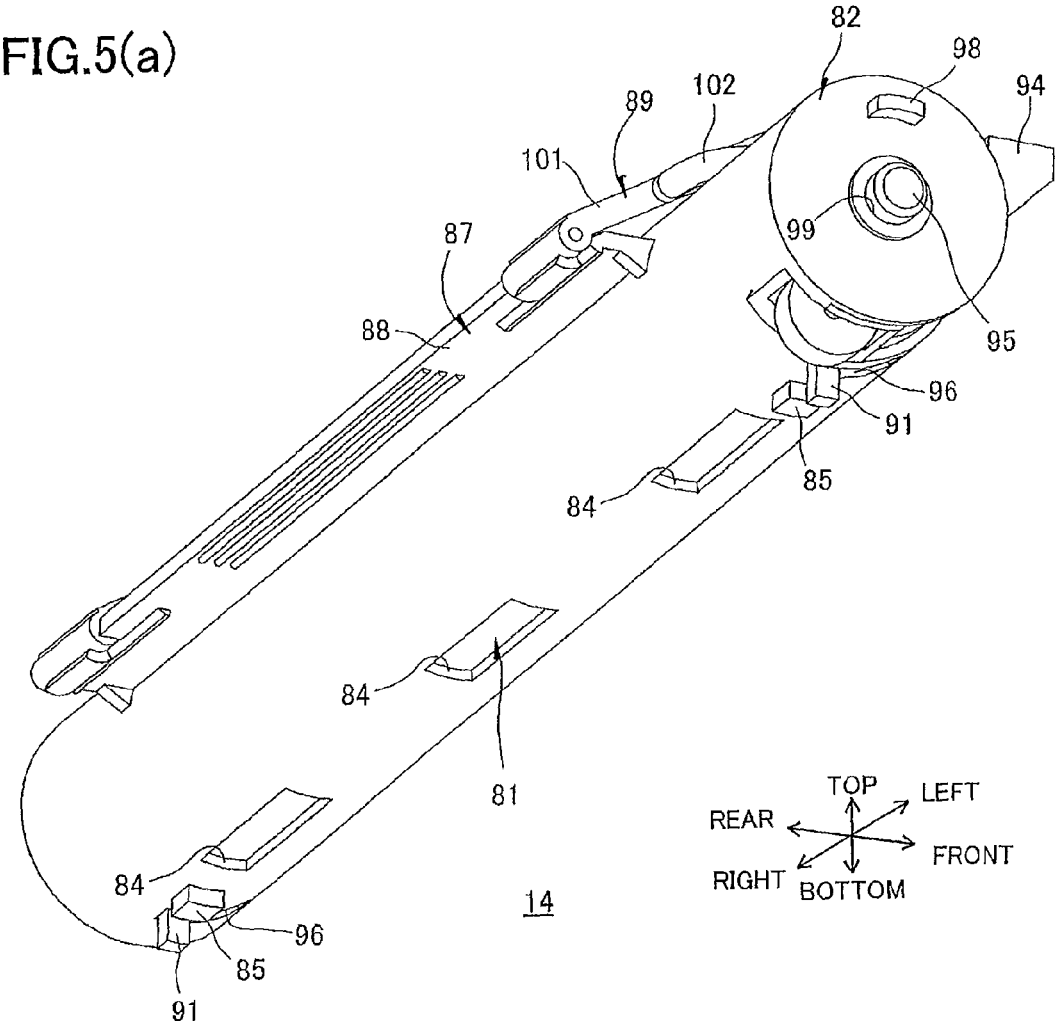
FIG. 5(*a*) is a perspective view of a developer cartridge provided in the image-forming device shown in FIG. 1 when the developer cartridge is in an open position.
Figure 5B:
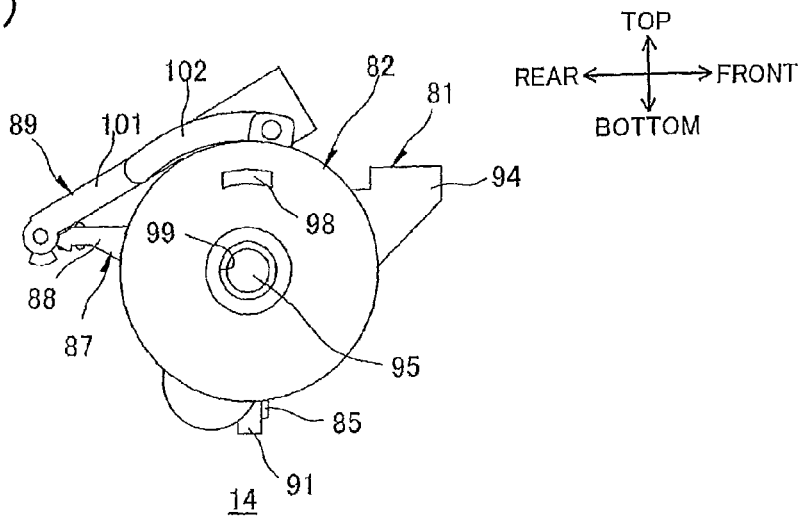

As shown in FIG. 5(*a*), the toner cartridge 14 has a general cylindrical shape and is elongated in the left-to-right direction. The toner cartridge 14 includes an inner case 81, an outer case 82, and a handle part 87.

(2-1) Inner Case

As shown in FIGS. 5(*a*) and 6, the inner case 81 has a hollow, substantially cylindrical shape and is elongated in the left-to-right direction. The inner case 81 functions to accommodate toner.

Cartridge support parts 95, cartridge fixing protrusions 91, and pressure-receiving parts 94 are provided on the inner case 81, while three cartridge openings 83 are formed in the inner case 81.

The cartridge support parts 95 are provided one on each left and right end of the inner case 81 and are aligned with the central axis of the inner case 81. The cartridge support parts 95 are substantially cylindrical in shape and extend outward from the left and right ends of the inner case 81 in the left and right directions, respectively.

The cartridge openings 83 are formed in the bottom region of the inner case 81. The cartridge openings 83 are substantially rectangular in a plan view and are arranged in a series at intervals in the left-to-right direction corresponding to positions opposing the developer openings 64.

The cartridge fixing protrusions 91 are provided one near each left and right end of the inner case 81. The cartridge fixing protrusions 91 are substantially square pillar-shaped and protrude downward from the bottom of the inner case 81.

The pressure-receiving parts 94 are formed on the top edge of the inner case 81, with one on each left and right end thereof. In a side view, each pressure-receiving part 94 is substantially triangular-shaped with one vertex pointing toward the front so that the pressure-receiving part 94 protrudes forward. The top edge of each pressure-receiving part 94 is aligned in the front-to-rear direction.

Figure 8:
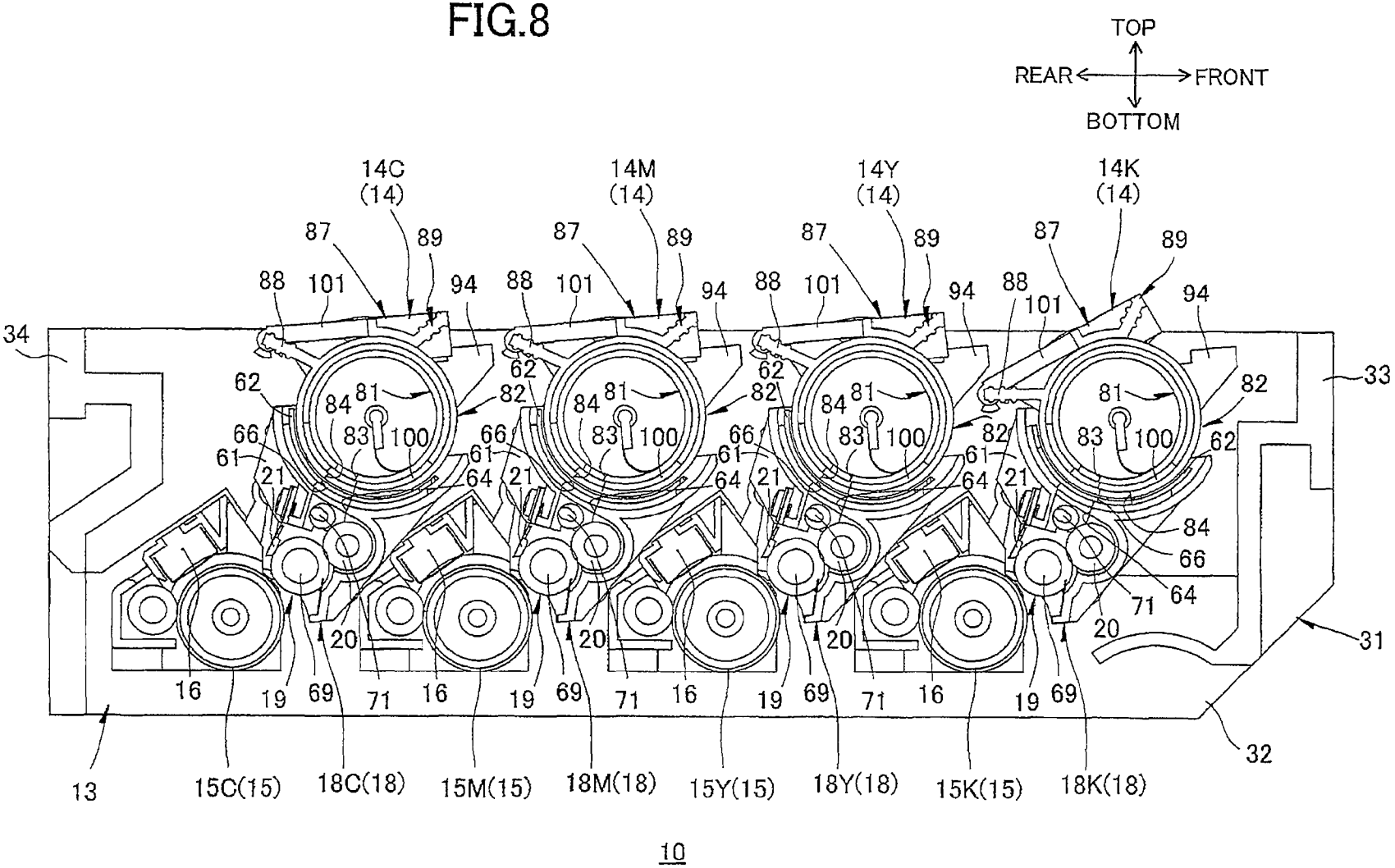
FIG. 8 is an explanatory diagram showing how to mount the developer cartridge on the drawer unit.

As shown in FIG. 8, toner seals 100 are affixed to the surface of the inner case 81 so as to surround the periphery of the cartridge openings 83. The toner seals 100 form seals between the inner case 81 and outer case 82 to prevent toner leakage.

(2-2) Outer Case

The outer case 82 is hollow with a substantially cylindrical shape for covering the outer peripheral surface of the inner case 81. The inner case 81 is accommodated in the outer case 82, but is capable of rotating relative to the outer case 82.

More specifically, in cross section, the outer case 82 has a general arc shape that conforms to the outer peripheral surface of the inner case 81.

Three outer case openings 84, a pair of left and right cartridge fixing protrusion insertion holes 96, and cartridge support part insertion holes 99 are formed in each outer case 82.

Additionally, pressure-receiving part insertion holes (not shown) are formed in the upper edge of the outer case 82. These insertion holes are open on the front side for receiving the pressure-receiving parts 94 of the inner case 81.

The outer case 82 is also provided with a pair of left and right shutter fixing protrusion 85, and a pair of left and right engaging pieces 98.

The outer case openings 84 are substantially rectangular in a plan view and are arranged in a series at intervals in the left-to-right direction so as to correspond to positions opposing the developer openings 64.

The cartridge fixing protrusion insertion holes 96 are formed near the left and right ends of the outer case 82 at positions corresponding to the cartridge fixing protrusions 91 provided on the inner case 81. The cartridge fixing protrusion insertion holes 96 are substantially rectangular in a plan view and have a front-to-rear length substantially equivalent to that of the cartridge fixing protrusion insertion holes 68 formed in the developing device shutter 62. The cartridge fixing protrusions 91 are inserted through the cartridge fixing protrusion insertion holes 96.

The cartridge support part insertion holes 99 are formed one in each of the left and right end faces of the outer case 82 and are aligned with the center axis of the same. The cartridge support part insertion holes 99 are substantially circular in a side view and can receive the cartridge support parts 95 of the inner case 81. The cartridge support parts 95 are inserted through the cartridge support part insertion holes 99 from the inner sides thereof and are capable of rotating relative to the cartridge support part insertion holes 99.

The shutter fixing protrusions 85 are disposed just inside the rear ends of the cartridge fixing protrusion insertion holes 96 with respect to the left and right directions. The shutter fixing protrusions 85 have a substantially square pillar shape and protrude downward from the outer case 82.

The engaging pieces 98 are formed one on each left and right end face of the outer case 82 at a position above the cartridge support part insertion hole 99. The engaging pieces 98 are ridges elongated in the front-to-rear direction and protruding outward from the end faces in the left and right directions. In a side view, the engaging pieces 98 are curved in a substantially arc shape that share its arc center with the central axis of the outer case 82.

The outer case 82 can move between a closed position (see FIG. 5(*a*)) for covering the outer case openings 84, and an open position (see FIG. 6) for uncovering the outer case openings 84. The outer case 82 is rotated clockwise in a left side view when moving from the closed position to the open position.

When the outer case 82 is in the closed position, the outer case openings 84 are positioned forward of the cartridge openings 83, and the inner wall surface of the outer case 82 covers the cartridge openings 83 (see FIG. 5(*a*)). Accordingly, the outer case 82 restricts the passage of toner through the cartridge openings 83 in this state.

Figure 6:
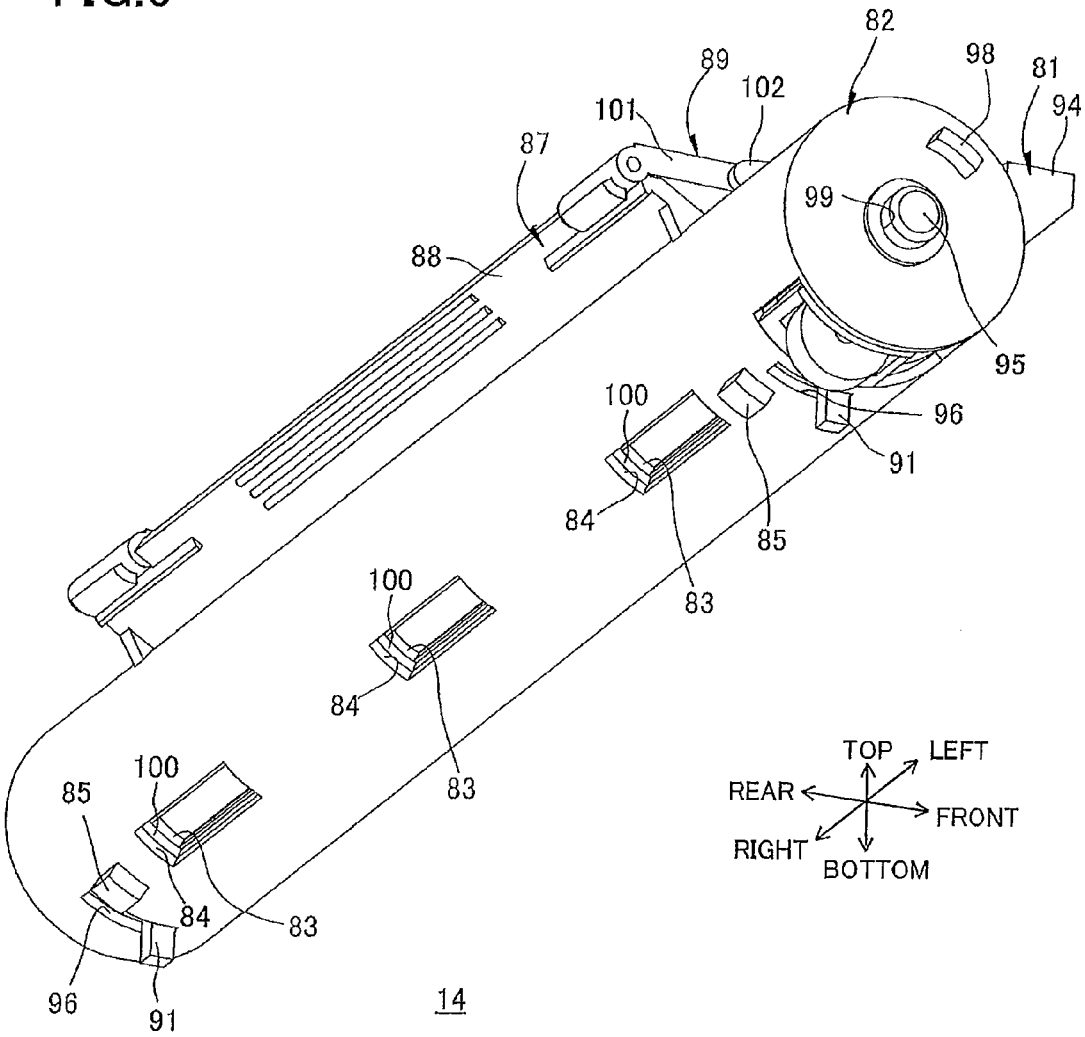
FIG. 6 is a perspective view of the developer cartridge provided in the image-forming device shown in FIG. 1 when the developer cartridge is in a closed position.

When the outer case 82 is in the open position, the outer case openings 84 confront and expose the cartridge openings 83 (see FIG. 6). Accordingly, the outer case 82 allows passage of toner through the cartridge openings 83 in this state.

(2-3) Handle Part

Figure 7A:
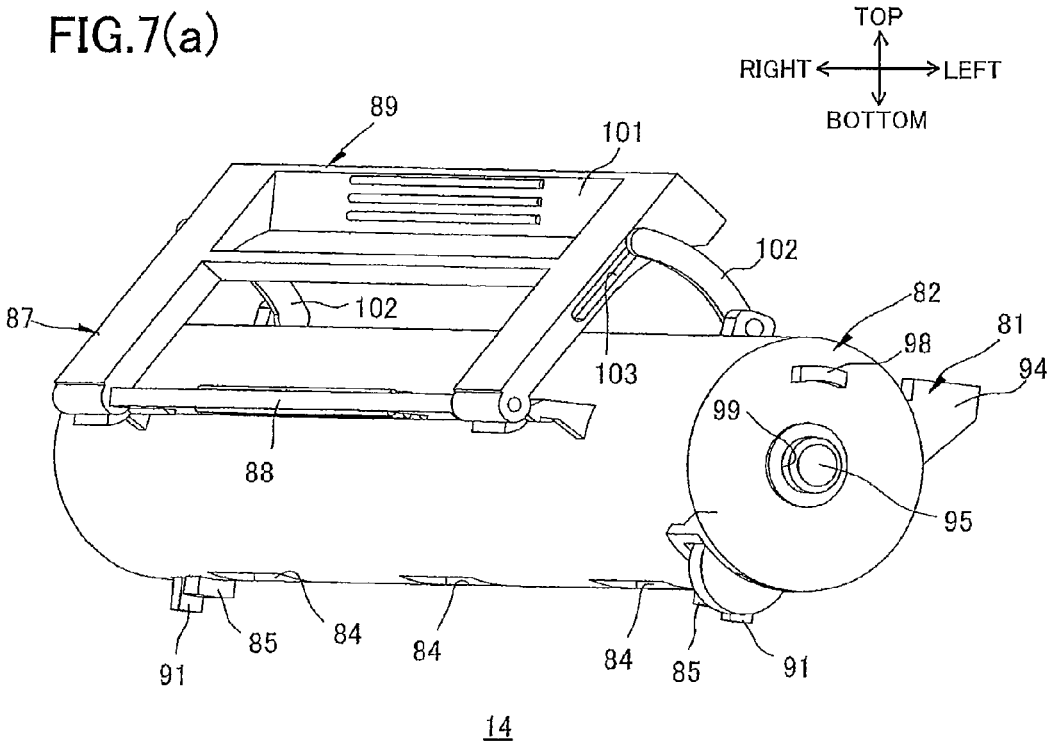
FIG. 7(*a*) is a perspective view of the developer cartridge provided in the image-forming device shown in FIG. 5(*a*) when a handle part of the developer cartridge is in a stand state.
Figure 7B:
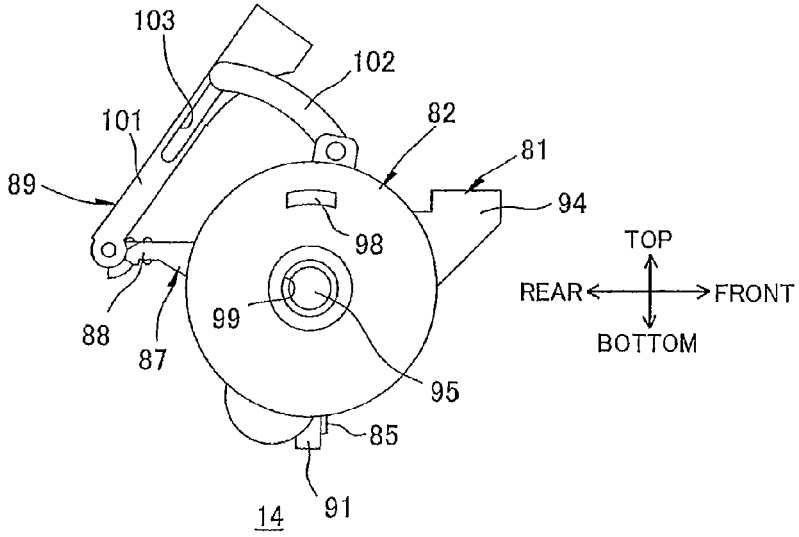

As shown in FIG. 7(*a*), the handle part 87 includes a first handle part 88 and a second handle part 89 for a user's gripping.

The first handle part 88 is formed on the lower rear end of the handle part 87 in substantially the left-to-right center of the rear portion of the outer case 82. The first handle part 88 is a ridge-like protrusion elongated in the left-to-right direction and protrudes rearward when the outer case 82 is in the closed position.

The first handle part 88 is disposed in a first position extending rearward when the outer case 82 is in the closed position and is in a second position extending diagonally upward and rearward when the outer case 82 is in the open position.

Figure 11:
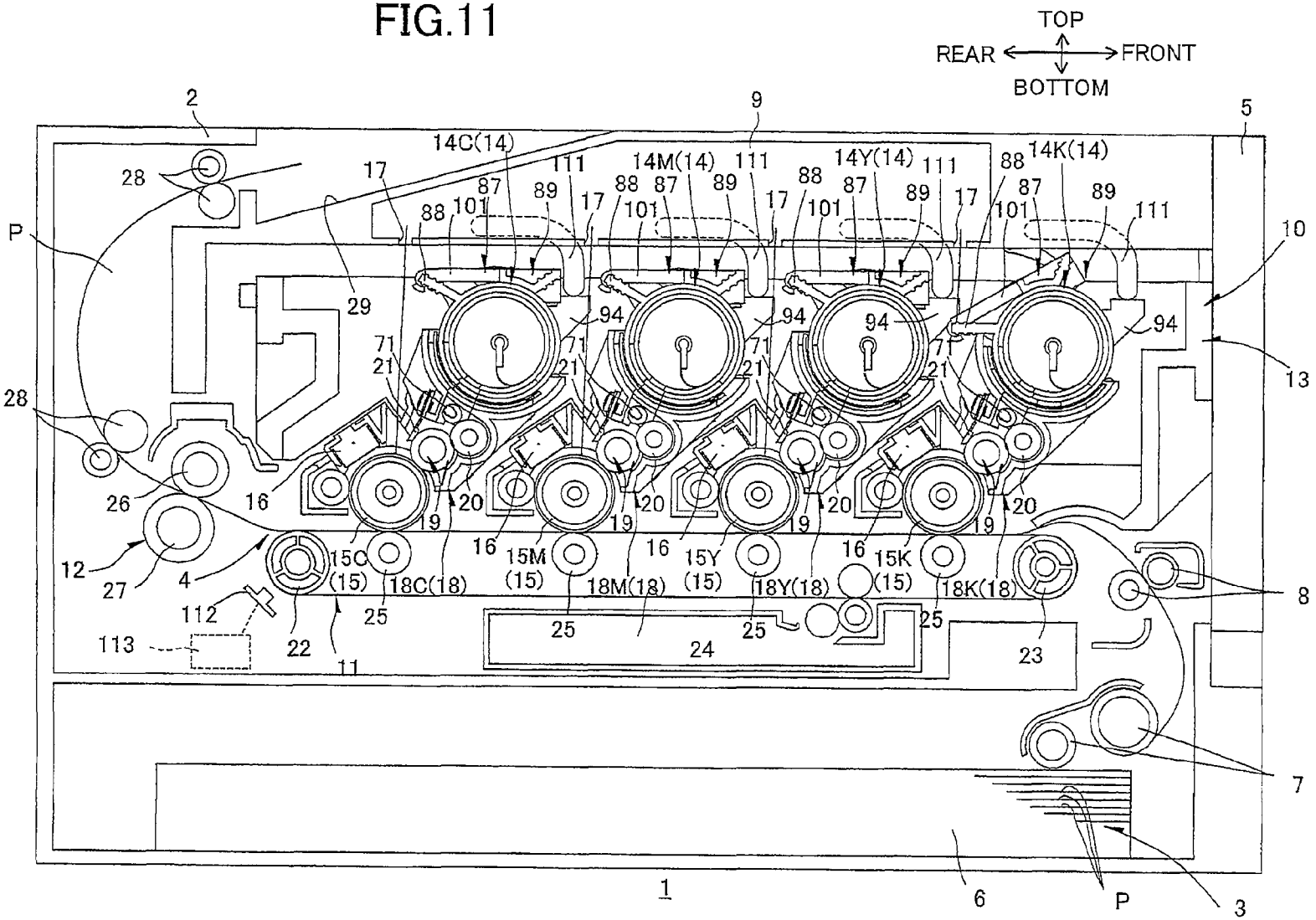
FIG. 11 is a cross-section side view of the image forming device during a test pattern reading operation performed by the image forming device.

The protruding length of the first handle part 88 is set such that the first handle part 88 projects into the irradiating path of the laser beam when disposed in the first position inside the main casing 2 (see the black toner cartridge 14K in FIG. 11), but is retracted from the irradiating path when in the second position (see the non-black toner cartridges 14 in FIG. 11).

The second handle part 89 includes a grip member 101, and a pair of left and right restricting members 102.

The grip member 101 is formed in a flat plate shape. In a plan view, the grip member 101 appears substantially U-shaped, with the opening of the "U" on the rear side. The rear ends of the grip member 101 are rotatably coupled with the rear end of the first handle part 88. A slide groove 103 is formed one in each of the outer left and right surfaces of the grip member 101 and is elongated in the front-to-rear direction. The slide grooves 103 receive the rear ends of the corresponding restricting members 102.

The restricting members 102 are rods formed in a narrow plate shape that curves gently while extending in the front-to-rear direction. The front end of each restricting member 102 is rotatably coupled in the top of the outer case 82, while the rear end is slidably fitted in the corresponding slide groove 103 of the grip member 101.

The second handle part 89 is operated between a collapsed state in which the grip member 101 contacts the outer periphery of the outer case 82, and a raised state in which the grip member 101 is separated from the outer periphery of the outer case 82.

More specifically, when the second handle part 89 is in the collapsed state shown in FIG. 5(*b*), the restricting members 102 are fitted in the rear ends of the corresponding slide grooves 103 formed in the grip member 101. In this state, the grip member 101 and restricting members 102 are collapsed onto the outer case 82 such that they almost entirely overlap one another in a left-to-right projection.

When the second handle part 89 is in the raised state shown in FIG. 7(*b*), the restricting members 102 are fitted into the front ends of the corresponding slide grooves 103 formed in the grip member 101. In this state, the grip member 101 and restricting members 102 are erected to form a general L-shape in a left-to-right projection.

3. Internal Structure of the Main Casing

As shown in FIG. 1, the main casing 2 is provided with pressing members 111, a patch sensor 112, a CPU 113, and pressing cams 114 (see FIG. 9(*a*)).

(1) Pressing Members

Four of the pressing members 111 are provided on the upper left and right edges of the main casing 2 at positions corresponding to the pressure-receiving parts 94 of the toner cartridges 14. The pressing members 111 apply pressure to the tops of the pressure-receiving parts 94.

(2) Patch Sensor and CPU

The patch sensor 112 is disposed diagonally below and rearward of the drive roller 22 provided in the transfer unit 11. The CPU 113 is connected to the patch sensor 112.

(3) Pressing Cams

As shown in FIG. 9, one of the pressing cams 114 is provided on each of the left and right sides of the main casing 2 adjacent to the process unit 10. Each pressing cam 114 includes a black pressing cam 115, and a color pressing cam 116.

The black pressing cam 115 is disposed adjacent to the separating cam 38 corresponding to the black developing device 18K. The black pressing cam 115 applies pressure to the top of the operating part 49 constituting the separating cam 38 that corresponds to the black developing device 18K. This black pressing cam 115 includes a drive shaft 117, and a levering member 118.

The drive shaft 117 is rotatably supported in the main casing 2 and extends in the front-to-rear direction. The drive shaft 117 is rotated by a drive force inputted from the main casing 2.

The levering member 118 is integrally provided with a cylindrical part 119 elongated in the front-to-rear direction, and a lever part 120 extending tangentially from the peripheral surface of the cylindrical part 119.

The drive shaft 117 of the black pressing cam 115 is inserted into the cylindrical part 119 of the levering member 118 in a relatively non-rotatable manner.

The color pressing cam 116 is disposed adjacent to the separating cams 38 corresponding to developing devices 18 for toner colors yellow, magenta, and cyan and applies pressure to the tops of the operating parts 49 constituting the separating cams 38 corresponding to these color developing devices 18. The color pressing cam 116 includes one long drive shaft 117, and three levering members 118 corresponding to the three colors yellow, magenta, and cyan.

The drive shaft 117 of the color pressing cam 116 is inserted into the cylindrical part 119 of each levering member 118 so as to be relatively non-rotatable with the same. Hence, the three levering members 118 are integrally held on a single drive shaft 117.

4. Mounting and Removal of the Toner Cartridges Relative to the Main Casing

Next, the operations for mounting a toner cartridge in and removing a toner cartridge from the main casing will be described with reference to FIG. 8. For this description, it will be assumed that the developing device shutters 62 of the developing devices 18 and the outer cases 82 of the toner cartridges 14 are in their respective closed positions.

To install a toner cartridge 14 in the main casing 2, first the operator pulls the drawer unit 13 out from the main casing 2 to the withdrawn position and mounts the toner cartridge 14 in the drawer unit 13.

When mounting a toner cartridge 14 in the drawer unit 13, the operator grips the second handle part 89 (in the raised state) of the toner cartridge 14, and positions the toner cartridge 14 over the drawer unit 13 so that the pressure-receiving parts 94 are facing forward and the cartridge fixing protrusions 91 and shutter fixing protrusions 85 are facing downward. The operator aligns the cartridge support parts 95 with the corresponding cartridge guide grooves 35 formed in the side plates 32 and inserts the toner cartridge 14 downward into the drawer unit 13.

At this time, the cartridge support parts 95 are fitted into the bottoms of the cartridge guide grooves 35 and the toner cartridge 14 is mounted in the drawer unit 13, as illustrated by the state of the black toner cartridge 14K in FIG. 8.

Through this process, the cartridge fixing protrusions 91 of the inner case 81 are inserted through cartridge fixing protrusion insertion holes 68 formed in the developing device shutter 62 and fitted in the cartridge fixing holes 65 formed in the developing device 18, thereby fixing the inner case 81 to the developing device 18. In addition, the shutter fixing protrusions 85 formed on the outer case 82 are fitted into the shutter fixing holes 67 formed in the developing device shutter 62, fixing the outer case 82 to the developing device shutter 62. Further, the engaging pieces 98 formed on the outer case 82 oppose outer case fitting grooves 37 formed in the drawer frame 31 in the front-to-rear direction.

Next, the operator presses the second handle part 89 of the toner cartridge 14 into the collapsed state. More specifically, the operator collapses the grip member 101 by sliding the rear ends of the restricting members 102 rearward in the corresponding slide grooves 103 formed in the grip member 101.

Next, the operator grips the handle part 87 of the toner cartridge 14 and rotates the outer case 82 forward. Through this operation, the outer case 82 rotates about the cartridge support parts 95 of the inner case 81 into the open position illustrated by the non-black toner cartridges 14 in FIG. 8. The developing device shutter 62 is also moved to the open position together with the outer case 82.

By performing this operation, the cartridge openings 83 formed in the inner case 81, the outer case openings 84 formed in the outer case 82, the developing device shutter openings 66 formed in the developing device shutter 62, and the developer openings 64 formed in the developing device 18 are all in communication with one another, allowing toner to pass from the inner case 81 to the developing device 18.

Further, when rotating the outer case 82, the engaging pieces 98 are fitted into the corresponding outer case fitting grooves 37 formed in the drawer frame 31.

After mounting the toner cartridges 14 in the drawer unit 13, the drawer unit 13 is slid to the accommodated position inside the main casing 2, completing the operation to mount the toner cartridges 14 in the main casing 2.

In order to remove a toner cartridge 14 from the main casing 2, the above operations for mounting the toner cartridge 14 in the main casing 2 are performed in reverse.

That is, the operator first pulls the drawer unit 13 out to the withdrawn position, then grips the first handle part 88 and rotates the toner cartridge 14 rearward. Next, the operator lifts the grip member 101 of the second handle part 89 until the second handle part 89 is in the raised state. By continuing to lift upward, the operator pulls the toner cartridge 14 upward and out of the drawer unit 13.

Once the toner cartridges 14 have been mounted in the main casing 2, the lever parts 120 of the pressing cams 114 are respectively positioned above operating parts 49 constituting the separating cams 38 for all colors, as shown in FIGS. 9(*a*) and 9(*b*).

Further, the pressing members 111 in the main casing 2 apply pressure to the tops of the pressure-receiving parts 94 for each toner cartridge 14, as shown in FIG. 10(*a*).

At this time, the toner cartridge 14 is integrally mounted with the developing device 18. Accordingly, when the pressure-receiving parts 94 of the toner cartridge 14 are pressed, the developing device 18 is pressed toward the photosensitive drum 15 together with the toner cartridge 14.

Here, the urging force of the compressed springs 51 applied to the operating lever parts 48 of the separating cams 38 is greater than the force with which the pressing members 111 push against the pressure-receiving parts 94. Therefore, the urging force of the compressed springs 51 constantly urge the separating cams 38 to rotate counterclockwise in a left side view and to press the developing roller shaft 69 of the developing device 18 forward with the contact parts 50.

With this construction, the developing device 18 is constantly separated from the photosensitive drum 15, as shown in FIG. 10(*b*). That is, when the developing device 18 is separated from the photosensitive drum 15, the pressure applied by the separating cams 38 to the developing device 18 is greater than the pressure applied by the pressing members 111 to the developing device 18.

5. Detecting the Open/Closed State of the Outer Cases

When the toner cartridges 14 are mounted in the main casing 2, the printer 1 initially performs the developing operation and transferring operation described earlier to form test patterns (patches) of toner by directly transferring toner onto the surface of the conveying belt 24.

As the conveying belt 24 circulates and the test patterns are brought opposite the patch sensor 112, the patch sensor 112 reads the test patterns to measure positional offset among test patterns in each color and image density.

By measuring positional offset among colors and image density for each color, the patch sensor 112 can simultaneously detect whether the outer case 82 of each toner cartridge 14 is open or closed. More specifically, when the outer case 82 of a toner cartridge 14 is in the open position, as in the examples of the non-black toner cartridges 14 shown in FIG. 11, the first handle part 88 is disposed in the second position. In the second position, the first handle part 88 extends diagonally upward and rearward and is retracted forward from the irradiating path of the laser beam. Consequently, the first handle part 88 does not block the laser beam being irradiated from the scanning unit 9 onto the corresponding photosensitive drum 15. Therefore, the laser beam can be irradiated on the photosensitive drum 15 to form a test pattern on the same.

In contrast, when the outer case 82 of a toner cartridge 14 is in the closed position, as in the example of the black toner cartridge 14K in FIG. 11, the first handle part 88 is disposed in the first position. In the first position, the first handle part 88 extends rearward and advances into the irradiating path of the laser beam. In other words, the outer case 82 is opened and closed in association with movement of the first handle part 88. Thus, when in the first position, the first handle part 88 blocks the laser beams being irradiated from the scanning unit 9 toward the corresponding photosensitive drum 15. Accordingly, the laser beam does not expose the photosensitive drum 15 and does not form a test pattern thereon.

In other words, the first handle part 88 functions as a shielding member and prevents the formation of test patterns in colors corresponding to the toner cartridges 14 whose outer cases 82 are in the closed position. If any colors are absent from the test patterns read from the patch sensor 112, the patch sensor 112 transmits information on the missing colors to the CPU 113. In this way, the CPU 113 can determine based on information of absent colors received from the patch sensor 112 that the first handle parts 88 of toner cartridges 14 corresponding to absent colors are not in the second position, i.e., that the outer cases 82 of toner cartridges 14 for the corresponding colors are not disposed in the open position. This information is displayed as an error on a display panel or the like (not shown).

When the CPU 113 does not receive any information for missing colors, the CPU 113 determines that the outer cases 82 for all colors are disposed in the open position.

6. Contact/Separation States of the Developing Devices

The operating mode of the color laser printer 1 can be switched between a color mode for forming color images, and a monochrome mode for forming black-only images.

(1) Color Mode

Figure 13A:
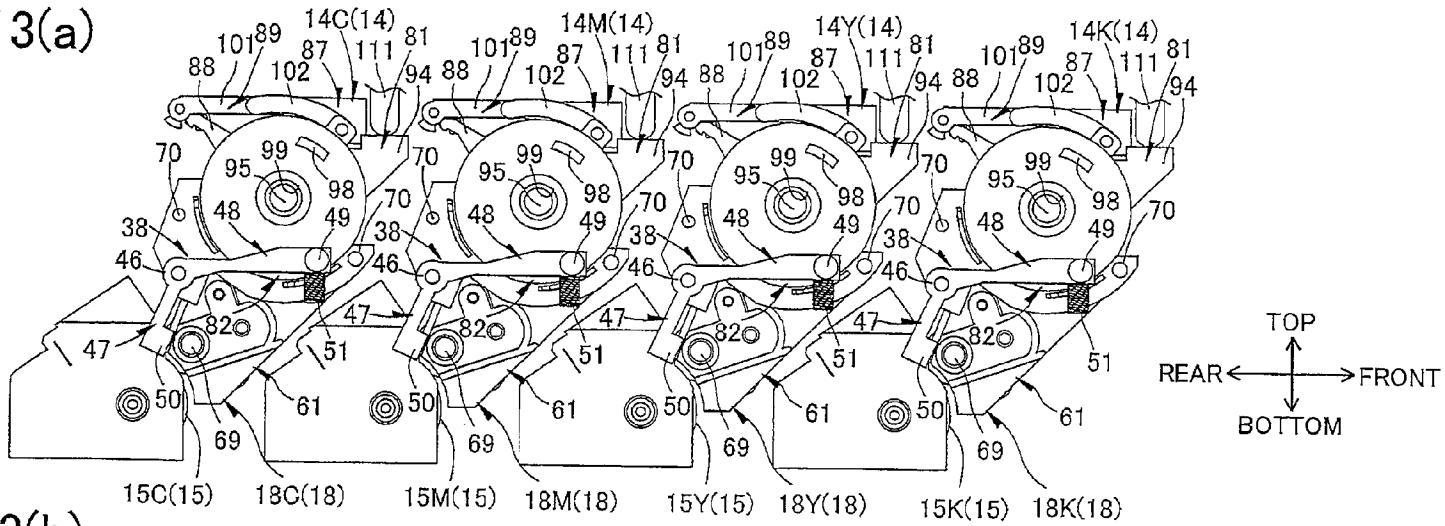
FIG. 13(*a*) is a side view of the process unit when each developing device is not pressed by a corresponding separating cam in the color mode.
Figure 13B:
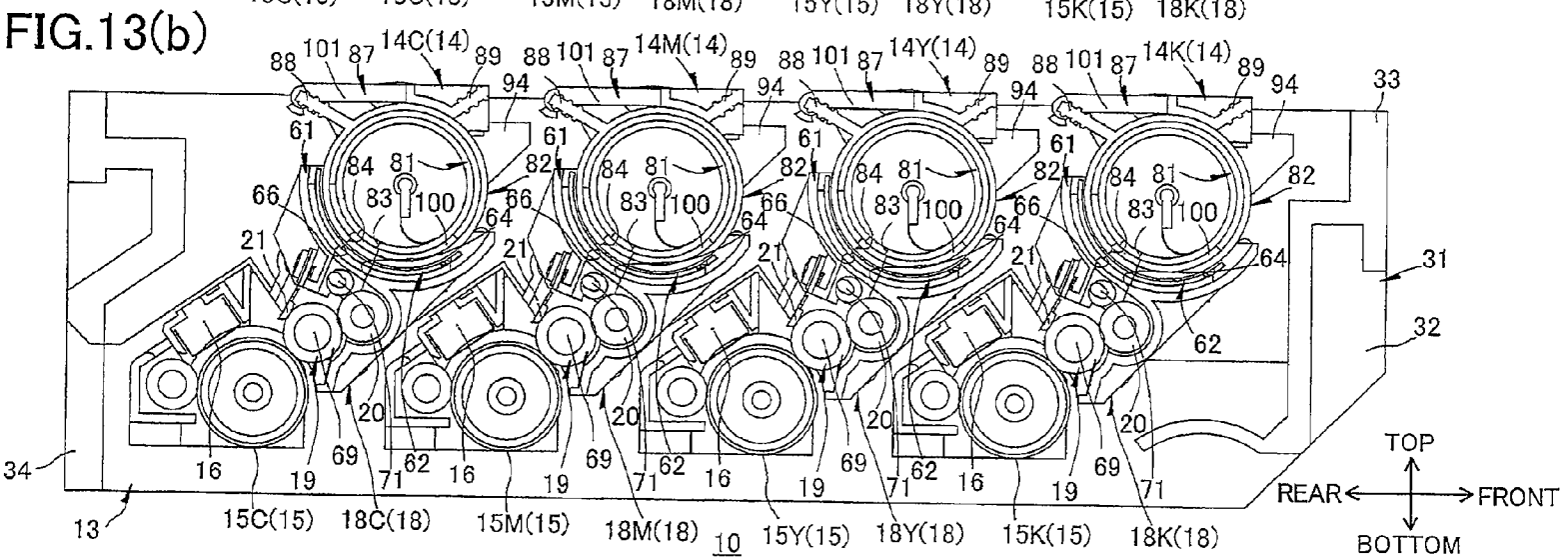

In the color mode, the developing rollers 19 of all developing devices 18 contact the corresponding photosensitive drums 15, as shown in FIG. 13(*b*).

Figure 12:
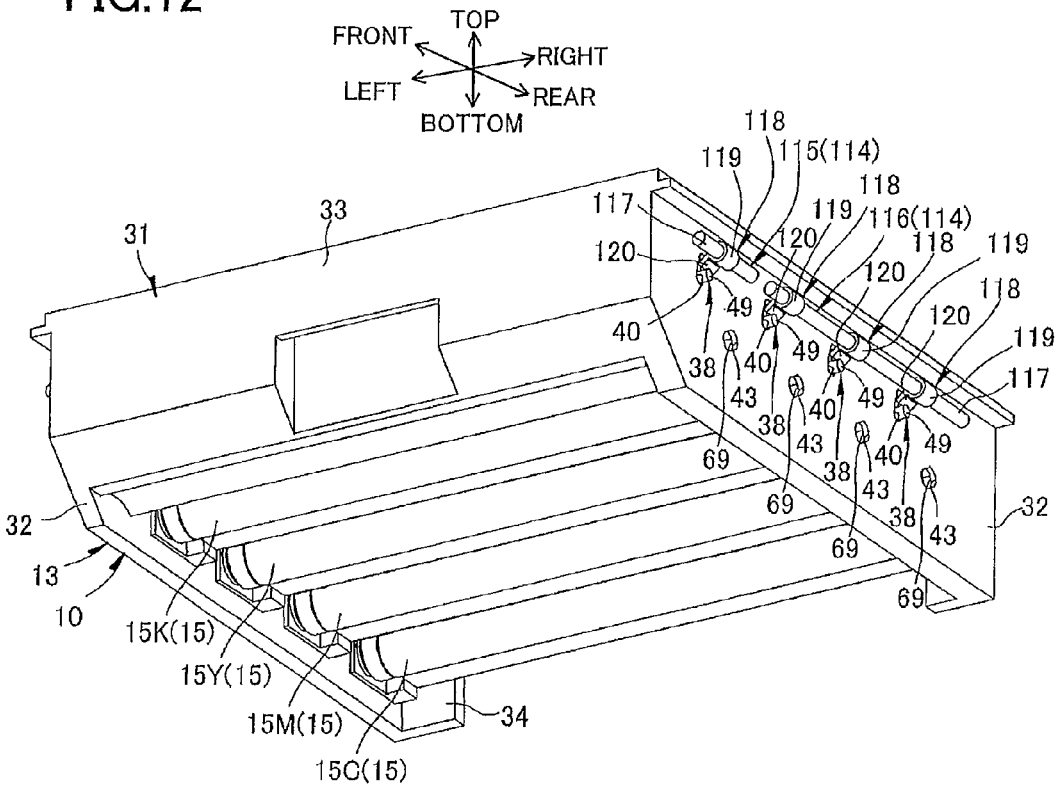
FIG. 12 is a perspective view of the process unit in a color mode performed by the image forming device.

In order to place the developing rollers 19 of all developing devices 18 in contact with all photosensitive drums 15, both the black pressing cam 115 and the color pressing cam 116 are rotated as shown in FIG. 12. Through this rotation, the lever parts 120 of both pressing cams 114 contact the operating parts 49 of the corresponding separating cams 38 from above and move the operating parts 49 downward against the urging force of the compressed springs 51.

As a result, the separating cams 38 rotate clockwise in a left side view, retracting the contact parts 50 from the corresponding developing roller shafts 69, as shown in FIG. 13(*a*) (release position). Hence, the pressure applied by the contact parts 50 to the corresponding developing roller shafts 69 is removed.

When the pressure of the contact parts 50 is removed from the developing roller shaft 69, the pressure of the pressing members 111 causes the developing device 18 to pivot clockwise in a left side view together with the toner cartridge 14 about the cartridge support parts 95 of the toner cartridges 14.

When the developing devices 18 pivot in this way, the developing rollers 19 of all developing devices 18 are placed in contact with the corresponding photosensitive drums 15. That is, by removing the pressure on the corresponding developing roller shafts 69, the separating cams 38 allow the developing rollers 19 of the developing devices 18 to contact the photosensitive drums 15.

(2) Monochrome Mode

Figures 15A, 15B:
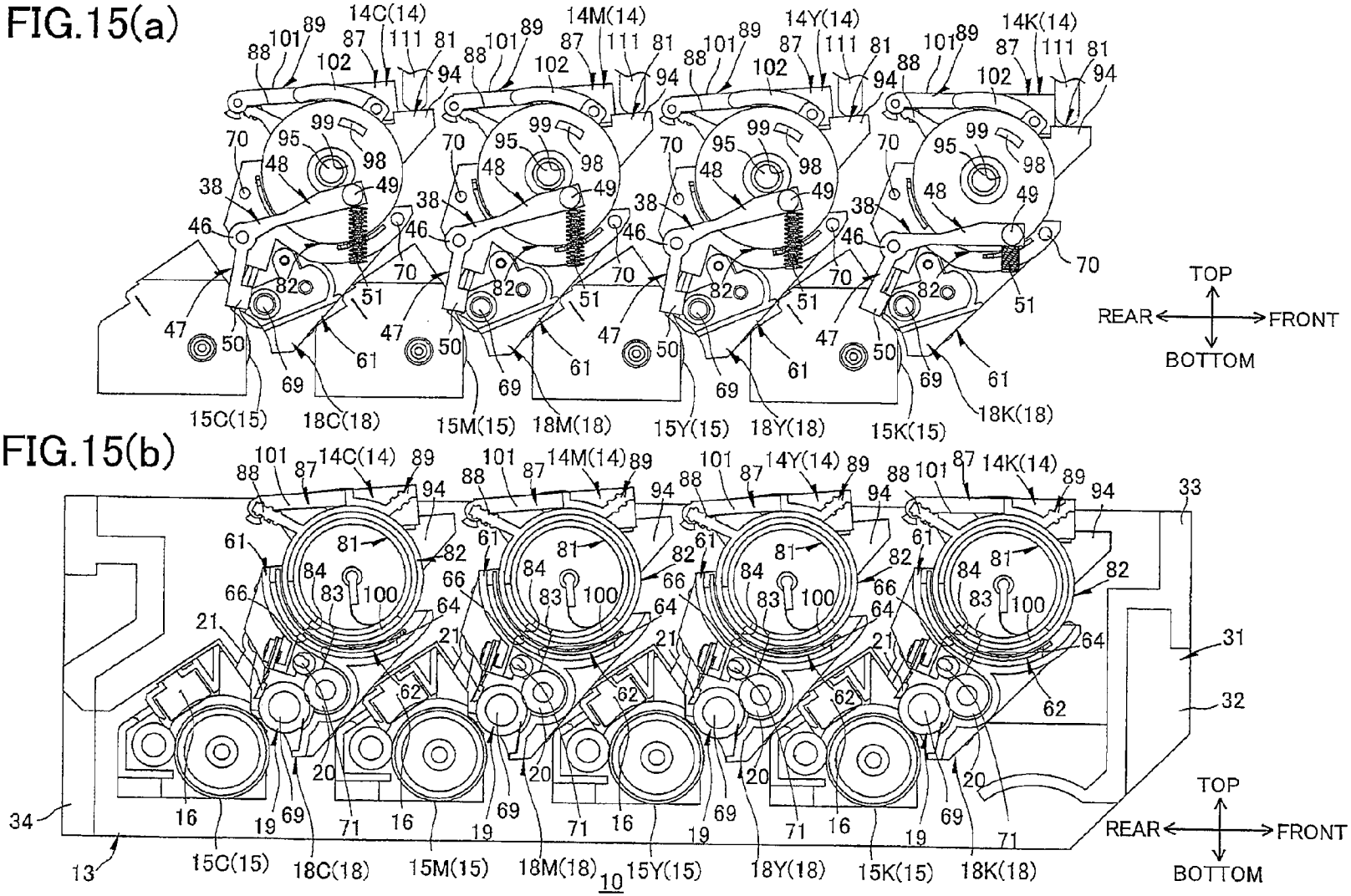
FIG. 15(*a*) is a side view of the process unit when each developing device is pressed by a corresponding separating cam in the monochrome mode.

In the monochrome mode, the developing roller 19 of the black developing device 18K is in contact with the black photosensitive drum 15K, while the developing rollers 19 of the non-black developing devices 18 are separated from the non-black photosensitive drums 15, as illustrated in FIG. 15(*b*).

Figure 14:
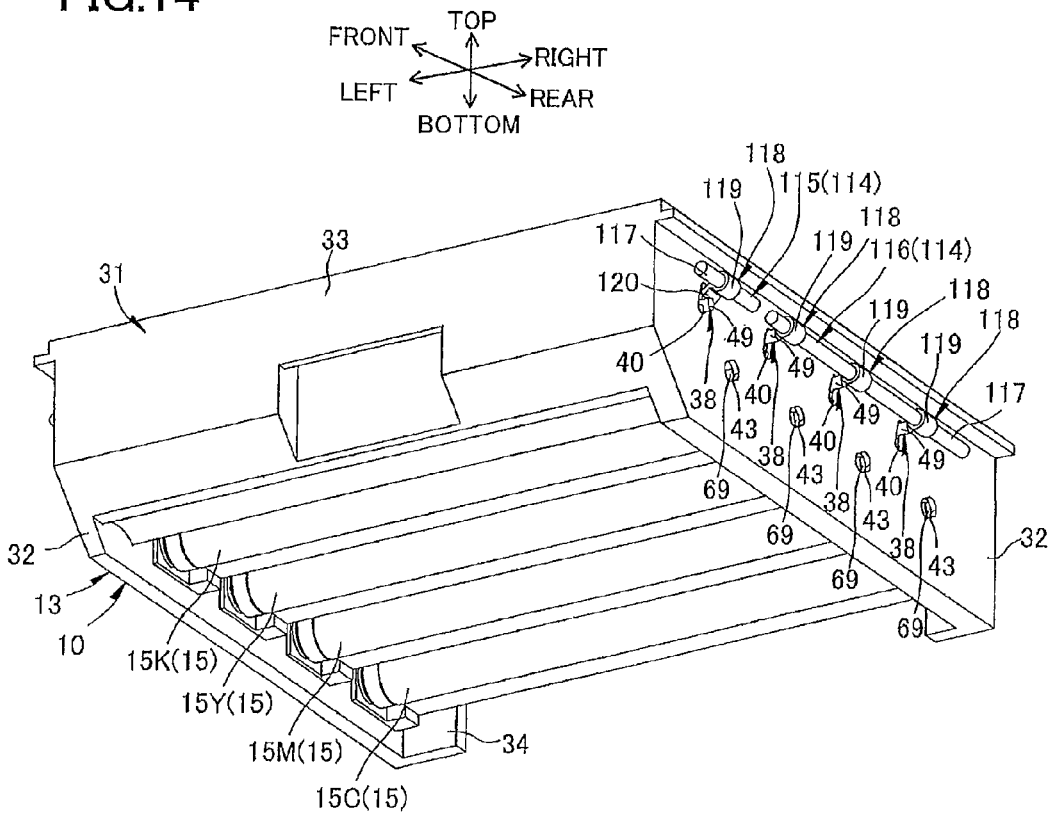
FIG. 14 is a perspective view of the process unit in a monochrome mode performed by the image forming device.

To achieve this mode, the black pressing cam 115 is rotated, but the color pressing cam 116 is not rotated, as illustrated in FIG. 14. Consequently, only the separating cam 38 corresponding to the black developing device 18K is rotated clockwise in a left side view, as illustrated in FIG. 15(*a*). This rotation removes the pressure applied by the contact parts 50 corresponding to the black developing device 18K against the developing roller shaft 69. When the pressure of the contact parts 50 against the developing roller shaft 69 is removed, the pressure of the corresponding pressing members 111 causes the black developing device 18K to pivot clockwise in a left side view together with the black toner cartridge 14K about the cartridge support parts 95 of the black toner cartridge 14K.

At this time, the developing rollers 19 of the non-black developing devices 18 remain separated from the corresponding photosensitive drums 15 due to the pressure applied by the corresponding separating cams 38 (pressing position). Accordingly, the developing roller 19 of the black developing device 18K is placed in contact with the black photosensitive drum 15K, while the developing rollers 19 of the non-black developing devices 18 are separated from the non-black photosensitive drums 15.

7. Operations and Effects (1) In the color laser printer 1 according to the above-described embodiment, each toner cartridge 14 is provided with the cartridge support parts 95, which are supported in the drawer unit 13, as shown in FIGS. 15(*a*) and 15(*b*). By pivoting the developing device 18 about these cartridge support parts 95, the developing roller 19 can be placed in contact with or separated from the corresponding photosensitive drum 15.

Accordingly, the toner cartridge 14 can easily be positioned relative to the drawer unit 13 through the cartridge support parts 95. Further, the developing device 18 can be pivoted about the cartridge support parts 95 of a toner cartridge 14 after the toner cartridge 14 is positioned, i.e., while the toner cartridge 14 is fixed in position relative to the drawer unit 13.

As a result, the toner cartridge 14 can easily be mounted in and removed from the drawer unit 13, even with a construction that allows the developing roller 19 of the corresponding developing device 18 to be separated from the photosensitive drum 15.

(2) In the printer 1 according to the above-described embodiment, the developing device 18 pivots together with the toner cartridge 14, as shown in FIGS. 15(*a*) and 15(*b*). This construction can prevent toner from leaking between the developing device 18 and the toner cartridge 14 when the developing device 18 is pivoted.

(3) The printer 1 according to the above-described embodiment is provided with pressing members 111 for pressing the developing devices 18 toward the photosensitive drums 15, as shown in FIG. 1. Therefore, the developing rollers 19 of the developing devices 18 can be reliably placed in contact with the corresponding photosensitive drums 15.

(4) As shown in FIGS. 15(*a*) and 15(*b*), the printer 1 according to the above-described embodiment is provided with the separating cams 38 for separating the developing rollers 19 of the developing devices 18 from the photosensitive drums 15.

The separating cams 38 can separate the developing rollers 19 of the developing devices 18 from the corresponding photosensitive drums 15 by applying pressure to the developing devices 18 with the contact parts 50, thereby allowing the developing rollers 19 of the developing devices 18 to contact the photosensitive drums 15 by removing this pressure applied to the developing devices 18.

Hence, by applying pressure to or removing pressure from the developing devices 18, the separating cams 38 can reliably place the developing rollers 19 of the developing devices 18 in contact with the photosensitive drums 15 or separate the developing rollers 19 from the photosensitive drums 15.

(5) When separating the developing rollers 19 of the developing devices 18 from the corresponding photosensitive drums 15, the separating cams 38 apply pressure to the developing devices 18 of a force greater than the force of pressure that the pressing members 111 apply to the developing devices 18. Accordingly, when applying pressure to the developing devices 18, the separating cams 38 can reliably separate the developing rollers 19 from the photosensitive drums 15, even while the pressing members 111 are pressing the developing devices 18 toward the corresponding photosensitive drums 15.

(6) As shown in FIGS. 5(*a*) and 5(*b*), the cartridge support parts 95 of the printer 1 are aligned with the central axis of each toner cartridge 14. Since the developing device 18 pivots about the cartridge support parts 95 of the corresponding toner cartridge 14, the developing devices 18 can be pivoted along a path following the outer periphery of the cylindrical toner cartridge 14. This construction enables the developing device 18 to be pivoted while the toner cartridge 14 is fixed in position relative to the drawer unit 13.

(7) As shown in FIGS. 5(*a*) through 6, each toner cartridge 14 is provided with the outer case 82, which can move between the open position for exposing the cartridge openings 83 formed in the inner case 81 to allow the passage of toner, and the closed position for covering the cartridge openings 83 to prevent the passage of toner.

The outer case 82 is also provided with the handle part 87. By operating the handle part 87, the operator can reliably open and close the corresponding outer case 82. Specifically, when removing the toner cartridge 14 from the drawer unit 13, the operation of the handle part 87 places the outer case 82 in the closed position to restrict the passage of toner. When mounting the toner cartridge 14 in the drawer unit 13, the operation of the handle part 87 places the outer case 82 in the open position to allow the passage of toner. Thus, this construction reliably prevents toner leakage when the toner cartridge 14 is mounted in and removed from the drawer unit 13.

(8) As shown in FIGS. 5(*a*) through 6, each toner cartridge 14 is provided with the cartridge fixing protrusions 91 for fixing the inner case 81 to the developing device frame 61 when the toner cartridge 14 is mounted in the drawer unit 13. Hence, the toner cartridge 14 and developing device frame 61 can be fixed in relation to one another when the toner cartridge 14 is mounted in the drawer unit 13. This construction reliably enables the developing device 18 and toner cartridge 14 to pivot together.

(9) As shown in FIGS. 5(*a*) through 6, each developing device 18 is provided with the developing device shutter 62, which is capable of moving between the open position for exposing the developer openings 64 formed in the developing device frame 61 to allow the passage of toner, and the closed position for covering the developer openings 64 to restrict the passage of toner. The toner cartridge 14 is also provided with the shutter fixing protrusions 85 for fixing the outer case 82 to the developing device shutter 62 when the toner cartridge 14 is mounted in the drawer unit 13.

Accordingly, the developing device shutter 62 can be opened and closed together with the outer case 82. Thus, when the toner cartridge 14 is removed from the drawer unit 13, the developing device shutter 62 is moved to the closed position together with the outer case 82 in order to restrict the passage of toner. When mounting the toner cartridge 14 in the drawer unit 13, the developing device shutter 62 is moved to the open position together with the outer case 82 in order to allow the passage of toner.

This construction can reliably prevent toner leakage when mounting the toner cartridge 14 in and removing the toner cartridge 14 from the drawer unit 13.

(10) As shown in FIGS. 5(*a*) through 6, the inner case 81 is hollow and substantially cylindrical in shape. The outer case 82 has substantially arcuate shape in a cross section and conforms to the outer periphery of the inner case 81. The outer case 82 can be moved between open and closed positions by rotating relative to the inner case 81.

Therefore, the outer case 82 can be switched between open and closed positions by rotating along the outer periphery of the inner case 81. Thus, the space required for opening and closing the outer case 82 is efficiently provided along the outer periphery of the inner case 81, thereby conserving space.

(11) As shown in FIGS. 5(*a*) through 6, the outer case 82 rotates about the cartridge support parts 95. Hence, the outer case 82 can be opened and closed while the toner cartridge 14 is fixed in position relative to the drawer unit 13.

(12) With the color laser printer 1 according to the above-described embodiment, the cartridge guide grooves 35 are formed in the side plates 32 of the drawer unit 13, and the cartridge support parts 95 of the toner cartridge 14 are supported in these cartridge guide grooves 35. Accordingly, the cartridge guide grooves 35 guide the toner cartridge 14 in the mounting and removal operations. With the cartridge support parts 95 supported in the cartridge guide grooves 35, the toner cartridge 14 is reliably mounted in and removed from the drawer unit 13 and can be positioned relative to the drawer unit 13.

(13) As shown in FIG. 3, pairs of the developing device support grooves 39 are formed in both side plates 32 constituting the drawer unit 13 for pivotably holding the developing devices 18. Hence, each developing device 18 can be reliably pivoted along the developing device support grooves 39.

(14) As shown in FIG. 11, when the outer case 82 of the corresponding toner cartridge 14 is in the closed position, the respective first handle part 88 is disposed in the first position for blocking the laser beam emitted from the scanning unit 9 toward the photosensitive drum 15. When the outer case 82 is in the open position, the first handle part 88 is disposed in the second position for not blocking the laser beam. Hence, when the outer case 82 of the toner cartridge 14 is in the closed position, the first handle part 88 can block the laser beam irradiated from the scanning unit 9 toward the photosensitive drum 15, preventing image formation.

This construction prevents malfunctions of the main casing 2 when the toner cartridge 14 is mounted in the main casing 2 while the corresponding outer case 82 remains in the closed position.

(15) As shown in FIG. 11, the first handle part 88 functions as a shielding member. Accordingly, the first handle part 88 can be used as a shielding member in addition to its function as a handle part, eliminating the need to provide a separate shielding member. Thus, this construction reduces the number of required parts for the toner cartridge 14.

(16) As shown in FIG. 1, the printer 1 is also provided with the patch sensor 112 for reading test patterns, and the CPU 113 for determining whether the first handle parts 88 are disposed in their second positions based on the test patterns read by the patch sensor 112. Accordingly, the test pattern reading operations performed by the patch sensor 112 can also be used to determine whether the first handle parts 88 are disposed in their second positions.

(17) As shown in FIG. 11, the outer case 82 is opened and closed in association with movement of the first handle part 88. Therefore, when the outer case 82 is in the open position, the first handle part 88 is reliably retracted from the irradiating path of the laser beam. Hence, the printer 1 can perform reliable image-forming operations when the outer cases 82 are in their open positions.

What is claimed is:

1. An image forming device comprising:

a photosensitive unit including a photosensitive body;

a developer cartridge accommodating developer therein and having a supported portion supported by the photosensitive unit;

a developing device disposed between the photosensitive unit and the developer cartridge and supported by the photosensitive unit and pivotally movable about the supported portion, the developing device including a developer carrying member carrying the developer thereon, the developer carrying member being movable, in accordance with pivotal movement of the developing device, between a contact position at which the developer carrying member is in contact with the photosensitive body and a separate position at which the developer carrying member is separated from the photosensitive body; and a reading unit configured to read a test pattern, wherein the photosensitive body comprises a plurality of photosensitive members juxtaposedly arrayed, the developer cartridge and the developing device being provided in one to one correspondence with the photosensitive member, wherein the photosensitive unit and the developing device constitute an image forming unit, wherein the image forming device further comprises:

a main frame providing an accommodation space for accommodating the image forming unit, the image forming unit being movable between an accommodated position in which the image forming unit is positioned in the accommodation space and a pulled out position in which the image forming unit is displaced from the accommodated space; and an emitting unit provided in the main frame and configured to emit a laser beam toward each photosensitive member; and wherein each developer cartridge is provided with a blocking member movable between a blocking position at which the laser beam directed toward each photosensitive member is shut-off and a transmitting position at which the laser beam is allowed to reach each photosensitive member, and wherein the image forming device further comprises:

a determining unit configured to determine whether or not the blocking member is positioned in the transmitting position based on the test pattern read by the reading unit.

2. The image forming device according to claim 1, wherein the developer cartridge is pivotable about the supported portion, the developer cartridge and the developing device being pivotally movable integrally.

3. The image forming device according to claim 1, further comprising a pressing member pressing the developer device toward the photosensitive body.

4. The image forming device according to claim 3, further comprising a separating member shiftable between a pressing position and a release position, in the pressing position the separating member applying a pressure to the developing device to place the developer carrying member in the separate position, and in the release position the separating member releasing the pressure to the developing device to place the developer carrying member in the contact position.

5. The image forming device according to claim 4, wherein the pressure applied by the separating member to the developing device is greater than a pressure applied by the pressing member to the developing device.

6. The image forming device according to claim 1, wherein the developer cartridge has a hollow cylindrical shape having a central axis; and wherein the supported portion is aligned with the central axis.

7. The image forming device according to claim 1, wherein the developer cartridge comprises:

a cartridge casing accommodating the developer and having a first opening which allows the developer to pass therethrough; and a first shutter member movable between a first open position at which the first shutter member opens the first opening and a first closed position at which the first shutter member closes the first opening, the first shutter member having a handle part to be gripped by a user for moving the first shutter member to one of the first open position and the first closed position.

8. The image forming device according to claim 7, wherein the developing device comprises a main body in which the developer carrying member is disposed; and wherein the developer cartridge includes a first fixing member fixing the cartridge casing to the main body.

9. The image forming device according to claim 8, wherein the main body has a second opening allowing the developer to pass therethrough, the second opening facing the first opening when the developer cartridge is mounted on the photosensitive unit;

wherein the developing device further comprises a second shutter member positioned in confrontation with the first shutter member upon installation of the developer cartridge on the photosensitive unit, the second shutter member being movable between a second open position at which the second shutter member opens the second opening and a second closed position at which the second shutter member closes the second opening; and wherein the developer cartridge further comprises a second fixing member fixing the first shutter member to the second shutter member, whereupon the second shutter member is positioned at the second open position when the first shutter member is positioned at the first open position and the second shutter member is positioned at the second closed position when the first shutter member is positioned at the first closed position.

10. The image forming device according to claim 7, wherein the cartridge casing has a hollow substantially-cylindrical shape having an outer peripheral surface; and wherein the first shutter member has an arcuate shape in cross-section in conformance with the outer peripheral surface, the first shutter member being pivotally movable relative to the cartridge casing between the first open position and the first closed position.

11. The image forming device according to claim 10, wherein the first shutter member is pivotally movable about the supported portion.

12. The image forming device according to claim 1, wherein the photosensitive body defines a longitudinal direction; and wherein the photosensitive unit comprises a pair of side plates extending in parallel to each other and spaced away from each other in the longitudinal direction, the pair of side plates having guiding grooves configured to guide movement of the developer cartridge toward and away from the photosensitive unit and to support the supported portion.

13. The image forming device according to claim 12, wherein the pair of side plates has supporting grooves configured to pivotally movably support the developing device.

14. The image forming device according to claim 1, wherein each of the blocking members is shaped to be a handle part for a user's gripping.

15. The image forming device according to claim 1, wherein the developer cartridge comprises:

a cartridge casing having an opening that allows the developer to pass outward; and a shutter movable to selectively open or close the opening, the shutter being moved in interlocking relation to movement of the blocking member.

16. An image forming device comprising:

a photosensitive unit including a photosensitive body;

a developer cartridge accommodating developer therein and having a supported portion supported by the photosensitive unit;

a developing device disposed between the photosensitive unit and the developer cartridge and supported by the photosensitive unit and pivotally movable about the supported portion, the developing device including a developer carrying member carrying the developer thereon, the developer carrying member being movable, in accordance with pivotal movement of the developing device, between a contact position at which the developer carrying member is in contact with the photosensitive body and a separate position at which the developer carrying member is separated from the photosensitive body; and a cartridge casing having an opening that allows the developer to pass outward, wherein the photosensitive body comprises a plurality of photosensitive members juxtaposedly arrayed, the developer cartridge and the developing device being provided in one to one correspondence with the photosensitive member, wherein the photosensitive unit and the developing device constitute an image forming unit, wherein the image forming device further comprises:

a main frame providing an accommodation space for accommodating the image forming unit, the image forming unit being movable between an accommodated position in which the image forming unit is positioned in the accommodation space and a pulled out position in which the image forming unit is displaced from the accommodated space; and an emitting unit provided in the main frame and configured to emit a laser beam toward each photosensitive member, wherein each developer cartridge is provided with a blocking member movable between a blocking position at which the laser beam directed toward each photosensitive member is shut-off and a transmitting position at which the laser beam is allowed to reach each photosensitive member, and wherein the image forming device further comprises:

a shutter movable to selectively open or close the opening, the shutter being moved in interlocking relation to movement of the blocking member.

17. The image forming device according to claim 16, wherein the developer cartridge is pivotable about the supported portion, the developer cartridge and the developing device being pivotally movable integrally.

18. The image forming device according to claim 16, further comprising a pressing member pressing the developer device toward the photosensitive body.

19. The image forming device according to claim 18, further comprising a separating member shiftable between a pressing position and a release position, in the pressing position the separating member applying a pressure to the developing device to place the developer carrying member in the separate position, and in the release position the separating member releasing the pressure to the developing device to place the developer carrying member in the contact position.

20. The image forming device according to claim 19, wherein the pressure applied by the separating member to the developing device is greater than a pressure applied by the pressing member to the developing device.

21. The image forming device according to claim 16, wherein the developer cartridge has a hollow cylindrical shape having a central axis; and wherein the supported portion is aligned with the central axis.

22. The image forming device according to claim 16, wherein the developer cartridge comprises:

a cartridge casing accommodating the developer and having a first opening which allows the developer to pass therethrough; and a first shutter member movable between a first open position at which the first shutter member opens the first opening and a first closed position at which the first shutter member closes the first opening, the first shutter member having a handle part to be gripped by a user for moving the first shutter member to one of the first open position and the first closed position.

23. The image forming device according to claim 22, wherein the developing device comprises a main body in which the developer carrying member is disposed; and wherein the developer cartridge includes a first fixing member fixing the cartridge casing to the main body.

24. The image forming device according to claim 23, wherein the main body has a second opening allowing the developer to pass therethrough, the second opening facing the first opening when the developer cartridge is mounted on the photosensitive unit;

wherein the developing device further comprises a second shutter member positioned in confrontation with the first shutter member upon installation of the developer cartridge on the photosensitive unit, the second shutter member being movable between a second open position at which the second shutter member opens the second opening and a second closed position at which the second shutter member closes the second opening; and wherein the developer cartridge further comprises a second fixing member fixing the first shutter member to the second shutter member, whereupon the second shutter member is positioned at the second open position when the first shutter member is positioned at the first open position and the second shutter member is positioned at the second closed position when the first shutter member is positioned at the first closed position.

25. The image forming device according to claim 22, wherein the cartridge casing has a hollow substantially-cylindrical shape having an outer peripheral surface; and wherein the first shutter member has an arcuate shape in cross-section in conformance with the outer peripheral surface, the first shutter member being pivotally movable relative to the cartridge casing between the first open position and the first closed position.

26. The image forming device according to claim 25, wherein the first shutter member is pivotally movable about the supported portion.

27. The image forming device according to claim 16, wherein the photosensitive body defines a longitudinal direction; and wherein the photosensitive unit comprises a pair of side plates extending in parallel to each other and spaced away from each other in the longitudinal direction, the pair of side plates having guiding grooves configured to guide movement of the developer cartridge toward and away from the photosensitive unit and to support the supported portion.

28. The image forming device according to claim 27, wherein the pair of side plates has supporting grooves configured to pivotally movably support the developing device.

29. The image forming device according to claim 16, wherein each of the blocking members is shaped to be a handle part for a user's gripping.

* * * * *